US010014166B2

(12) United States Patent
Baba

(10) Patent No.: US 10,014,166 B2
(45) Date of Patent: Jul. 3, 2018

(54) INLINE ION REACTION DEVICE CELL AND METHOD OF OPERATION

(71) Applicant: DH Technologies Development Pte. Ltd., Singapore (SG)

(72) Inventor: Takashi Baba, Richmond Hill (CA)

(73) Assignee: DH Technologies Development Pte. Ltd., Singapore (SG)

( * ) Notice: Subject to any disclaimer, the term of this patent is extended or adjusted under 35 U.S.C. 154(b) by 0 days.

(21) Appl. No.: 14/894,359

(22) PCT Filed: May 29, 2014

(86) PCT No.: PCT/IB2014/000893

§ 371 (c)(1),
(2) Date: Nov. 26, 2015

(87) PCT Pub. No.: WO2014/191821

PCT Pub. Date: Dec. 4, 2014

(65) Prior Publication Data

US 2016/0126076 A1 May 5, 2016

Related U.S. Application Data

(60) Provisional application No. 61/828,757, filed on May 30, 2013.

(51) Int. Cl.
*H01J 49/00* (2006.01)
*H01J 49/06* (2006.01)

(52) U.S. Cl.
CPC ..... *H01J 49/0054* (2013.01); *H01J 49/0072* (2013.01); *H01J 49/063* (2013.01); *H01J 49/0045* (2013.01)

(58) Field of Classification Search
None
See application file for complete search history.

(56) References Cited

U.S. PATENT DOCUMENTS 5,073,713 A * 12/1991 Smith ..... H01J 49/004 250/282
6,800,851 B1 10/2004 Zubarev et al.
6,919,562 B1 7/2005 Whitehouse et al.
(Continued)

FOREIGN PATENT DOCUMENTS

WO 2004-065919 8/2004
WO 2011-028450 3/2011

OTHER PUBLICATIONS

Takashi Baba et al., "Electron capture Dissociation in a Radio Frequency Ion Trap", Anal. Chem., 2004, 76 (15), pp. 4263-4266.
(Continued)

*Primary Examiner* — Wyatt Stoffa
*Assistant Examiner* — James Choi

(57) ABSTRACT

A method and apparatus for conducting ion to charged species reactions, more particularly reactions wherein the charged species is an electron, such as ECD. The apparatus comprises first and second pathways which are orthogonal to one another. The first pathway through which ions are introduced comprises multiple multipoles with a gap situated there between. The second pathway introduces the charged species through the gap orthogonally to the first pathway. In this way, a cross-type reaction device allows ion-charged species interactions to occur.

18 Claims, 16 Drawing Sheets

(56) References Cited

U.S. PATENT DOCUMENTS

| | | | | |
|---|---|---|---|---|
| 6,995,366 | B2 | 2/2006 | Franzen | |
| 7,060,987 | B2 | 6/2006 | Lee et al. | |
| 7,166,835 | B2 | 1/2007 | Baba et al. | |
| 7,196,326 | B2 | 3/2007 | Franzen et al. | |
| 7,309,860 | B2 | 12/2007 | Baba et al. | |
| 7,829,845 | B2 | 11/2010 | Deguchi et al. | |
| 7,928,363 | B2 | 4/2011 | Bateman | |
| 8,274,044 | B2 | 9/2012 | Yoshioka et al. | |
| 9,431,230 | B2 * | 8/2016 | Baba | H01J 49/427 |
| 9,837,256 | B2 * | 12/2017 | Baba | H01J 49/0095 |
| 2002/0008198 | A1 | 1/2002 | Kasten et al. | |
| 2002/0185596 | A1 | 12/2002 | Amy et al. | |
| 2004/0079874 | A1 * | 4/2004 | Bateman | H01J 49/004 250/281 |
| 2004/0245448 | A1 | 12/2004 | Glish et al. | |
| 2006/0169892 | A1 * | 8/2006 | Baba | H01J 49/005 250/292 |
| 2007/0057178 | A1 * | 3/2007 | Chernushevich | H01J 49/107 250/288 |
| 2008/0116372 | A1 | 5/2008 | Hashimoto et al. | |
| 2010/0176293 | A1 * | 7/2010 | Wuest | H01J 49/08 250/288 |
| 2011/0204221 | A1 * | 8/2011 | Satake | H01J 49/0031 250/282 |
| 2013/0026360 | A1 * | 1/2013 | Stoermer | H01J 49/0072 250/292 |

OTHER PUBLICATIONS

Hiroyuki Satake et al. "Fast Multiple Electron Capture Dissociation in a Linear Radio Frequency Quadrupole Ion Trap", Anal. Chem., 2007, 79 (22), pp. 8755-8761.

* cited by examiner

INLINE ION REACTION DEVICE CELL AND METHOD OF OPERATION

RELATED APPLICATION

This application claims the benefit of U.S. Provisional Patent Application Ser. No. 61/828,757, filed May 30, 2013, the content of which is incorporated by reference herein in its entirety.

FIELD

The within teachings are directed to ion reaction devices and methods of operations.

BACKGROUND

Ion reactions typically involve the reaction of either a positively or negatively charged ion with another charged species, which can be another positively or negatively charged ion or an electron.

In electron induced dissociation, an electron is captured by an ion which can result in the fragmentation of the ion. Electron induced dissociation can be used as a technique to dissociate bio-molecules in mass spectrometry (MS) though it can also be utilized in other applications. These capabilities cover a wide range of possible applications from regular proteomics in Liquid chromatography-Mass spectrometer/mass spectrometer to top down analysis (no digestion), de novo sequencing (abnormal amino acid sequencing finding), post translational modification study (glycosylation, phosphorylation, etc.), protein-protein interaction (functional study of proteins), and also including small molecule identification.

After the first report of electron capture dissociation (ECD) using electrons with kinetic energy of 0 to 3 eV, other electron induced techniques have also been reported including electron transfer dissociation (ETD) using reagent anions, Hot ECD using electrons with kinetic energy of 5 to 10 eV, electron ionization dissociation (EID) using electrons with kinetic energy of greater than 3 eV, activated ions ECD (AI-ECD), electron detachment dissociation (EDD) using electrons with kinetic energy of greater than 3 eV, negative ETD using reagent cations, and negative ECD using electrons. ECD, ETD and Hot ECD have been developed for positively charged precursor ions, while others have been developed for negatively charged precursor ions. EID can dissociate both polarities including singly charged precursors. These techniques are very useful for bio molecular species, such as peptides, proteins, glycans and post translationally modified peptides/proteins. ECD also allows top down analysis of proteins/peptides and de-novo sequencing of them. Proton transfer reactions (PTR) can also be utilized to reduce the charge state of ions in which a proton is transferred from one charged species to another.

These electron induced dissociations are considered to be complimentary to conventional collision induced or activated dissociations (CID or CAD) and have been incorporated in advanced MS devices. ETD is especially utilized in these devices.

In ECD, low energy (typically <1 eV) electrons are captured by positive ions. Historically, ECD was performed in Fourier transform ion cyclotron resonance (FT-ICR) mass spectrometry because FT-ICR utilized a static electro-magnetic field for ion confinement that avoided the heating of free electrons. Such devices required relatively long interactions times and involved large instruments that were expensive to build. Attempts to use ECD in smaller applications involving Radio Frequency (RF) ion traps have been found to cause acceleration of electrons by the trapping RF field. To overcome this, ETD and other electron induced techniques have been used such as the use of negatively charged reagent ions as the electron source, and the use of ECD implemented in a linear RF ion trap with a magnetic field.

The usage of the term ECD in the present teachings hereinafter should be understood to encompass all forms of electron related dissociation techniques and not limited to only the usage of ECD with electrons with kinetic energy of 0 to 3 eV. The usage of ECD within the present teachings is therefore representative and should be understood to include all forms of electron related dissociation phenomenon including hot ECD, EID, EDD and negative ECD.

The conventional use of ECD and ETD to effect ionization in a trapping device require relatively long reaction times between precursor ions and reagent ions for dissociation, being electrons in case of ECD and anions in ETD. When used with ETD, anion and cations should be trapped simultaneously to obtain enough dissociation. The trapping operation is required in the case of ECD, when the linear trap is used as a reaction device and the electron injection and ion injection/extraction share the same ports (or the same end lens electrodes). Trapping operations, which require multiple steps, have poor compatibility with conventional CID based Quadrupole Time-of-Flight mass spectrometers (QTOF), which operate in a continuous flow through manner.

Parallel injection of electron beam and ions in an ECD implementation in a linear ion trap has been found to limit the sensitivity of ECD (Anal. Chem., 2004, 76 (15), pp 4263-4266, herein incorporated by reference). Non-parallel injection of electrons and ions has also been reported (Anal. Chem., 2007, 79 (22), pp 8755-8761, herein incorporated by reference) but suffers from electron bean disturbances in ion injection and ejection since electron beams interact with the lens electrode of an RF ion trap, producing an insulating surface on the electrode which causes electrons to charge up causing an uncontrollable change of focusing (lens) fields. This causes unstable and unpredictable surface potential change so that ion injection and ejection became uncontrollable Transverse electron injections have been disclosed (U.S. Pat. No. 6,995,366, WO11 028 450, both documents incorporated by reference herein), but these configurations suffer from scattering of the electrons by the ion trap RF field given. Multiple ion pathway devices have also been disclosed that couple multiple ion source pathways together to an outlet to a mass spectrometer in a T shaped configuration, however these are complicated and expensive to construct.

SUMMARY

In accordance with some broad teachings, methods and apparatus of a cross ion pathway type device for ion reaction is disclosed.

In various embodiments, a crossed ion pathway type device for ion trapping and electron injection is disclosed. In this configuration, ion pathway and electron beam injection are separated.

In various embodiments, an electron beam can be focused by a set of a non-phase inverted and a phase inverted linear RF fields with magnetic field. The traveling electrons can be defocused by a coupling field of linear radio frequency quadrupole (RFQ) and the magnetic field. The RF field phase can then be inverted during the travel so that the electrons, which were defocused, are focused again.

In various embodiments, a device is disclosed that avoids unpredictable ion motion deficiency by electron beam injection. In some embodiments, the electron beam is focused which can improve reaction efficiency so filament life time can be elongated by decreasing the filament current. In some embodiments, continuous ECD or flow through ECD can be performed so that an optimum duty cycle for TOF measurement is realized.

In various embodiments, a device is disclosed that minimizes electron beam disturbance using a transverse electron injection method. In some embodiments, a device is disclosed that utilizes a cross shaped ion guide structure with a magnetic field to allow for ECD reactions.

In various embodiments, a device is provided which allows inline configuration. In some embodiments, a device is disclosed that avoids electron beam disturbance to ion injection and ejection.

In various embodiments, a device is provided that allows ECD to function in a continuous/flow through operation that allows compatibility with conventional CID based processes. In some embodiments, a device is disclosed that enables other ion operation techniques, such as ETD and proton transfer reactions (PTR) to operate in a similar fashion.

In various embodiments, a device is provided that can also be utilized in PTR applications to enable charge control of precursor ions and product ions by ECD, which can provide high sensitivity and simple dissociation spectra that are easy to analyze.

In various embodiments, a charged species can be introduced into the device. In some embodiments, the charged species is an electron that is produced by an electron source which can be a filament (tungsten, thoriated tungsten and others) or an electron emitter, including $Y_2O_3$ cathode.

In some embodiments, reaction apparatus for ions is disclosed that includes a first pathway comprising a first axial end and a second axial end disposed at a distance from the first pathway axial end along a first central axis; a second pathway comprising a first axial end and a second axial end disposed at a distance from the first axial end of the second pathway along a second central axis. The first and second central axis are substantially orthogonal to one another and meet at an intersection point. The reaction apparatus may also include a first set of quadrupole electrodes arranged in a quadrupole orientation around the first central axis and positioned between the first axial end of the first pathway and the intersection point. The first set of electrodes guides ions along a first portion of the first central axis. The apparatus can also contain a second set of quadrupole electrodes arranged in a quadrupole orientation around the first central axis and positioned between the second axial end of the first pathway and the intersection point. The second set of electrodes guides ions along a second portion of the first central axis. The first and second set of electrodes are separated from one another so as to form a gap transverse to the first central axis. The reaction apparatus may also contain a voltage source for providing an RF voltage to the first and second sets of electrodes to generate an RF field, a controller for controlling the RF voltages and an ion source and a charged species source. The ion source is situated at or proximate to either the first or second axial end of the first pathway for introducing ions along the first central axis towards the other of the first or second axial end of the first pathway. The charged species source is situated at or proximate to either the first or second axial end of the second pathway for introducing a charged species along the second central axis, the charged species travelling through said gap towards the intersection point.

In some embodiments, methods for performing an electron capture dissociation reaction are described which can include providing a first pathway comprising a first axial end and a second axial end disposed at a distance from the first pathway axial end along a first central axis, providing a second pathway comprising a first axial end and a second axial end disposed at a distance from the second pathway axial end along a second central axis, positioning the first and second central axis such that the first and second central axis are substantially orthogonal to one another and having an intersection point, providing a first set of quadrupole electrodes arranged in a quadrupole orientation around the first central axis and positioned between the first axial end of the first pathway and the intersection point, the first set of electrodes for guiding ions along a first portion of the first central axis, providing a second set of quadrupole electrodes arranged in a quadrupole orientation around the first central axis and positioned between the second axial end of the first pathway and the intersection point, the second set of electrodes for guiding ions along a second portion of the first central axis, separating the first set of electrodes from the second set of electrodes so as to form a gap transverse to the first central axis, providing a magnetic field parallel to said second central axis, providing RF voltages to said first and second sets of electrodes, providing a controller for controlling the RF voltages so as to control the RF fields generated by the first and second sets of electrodes, introducing a plurality of positively charged ions into either the first or second axial end of the first pathway along the first central axis; and introducing electrons into the first or second axial end of the second pathway along the second central axis, the electrons travelling through said gap towards the intersection point In some embodiments, the apparatus may comprise a magnetic field generator that generates a magnetic field parallel to and along the second central axis. In some particular embodiments, the ions are positively charged and the charged species are electrons. The electrons can be generated from a filament, preferably tungsten or thoriated tungsten or can be generated from a $Y_2O_3$ cathode. In other embodiments, the charged species are reagent anions.

Other embodiments include the presence of a gate electrode positioned in the first pathway at or proximate to the end opposite of the first or second end at which the ions are introduced. In yet other embodiments, a gate electrode may be positioned at or proximate to both ends of the first pathway. One of the gates electrodes for controlling the entrance of ions into the apparatus and the other gate electrode for controlling the removal of ions or reaction products of the ions. Gate electrodes may also be situated at or proximate to both the first or second ends of the second pathway. In various embodiments, the apparatus can further comprise a controller for controlling the gate electrodes.

Embodiments of the apparatus and method may also include the use of or provision of lenses positioned in the second pathway at or proximate to the first or second ends for focusing of the charged species.

Select embodiments may include a laser source positioned in the second pathway situated at or proximate the end opposite the end in which the charged species is introduced. In some embodiments, the laser source provides either ultraviolet or infrared light.

In some embodiments, both ends of the second pathway comprise a charged species source, where the charged species are electrons and only one of the sources is operational at a time.

In some embodiments, the ions interact with the charged species source and the interaction can potential cause electron capture dissociation, electron transfer dissociation or proton transfer dissociation.

In select embodiments, the RF fields generated are at a frequency of between about 400 kHz to 1.2 MHz, more particularly, the frequency is about 800 kHz.

In several embodiments, the method includes providing a gate electrode in the first pathway at or proximate to the end that is opposite the end at which the positively charged ions are introduced. In some embodiments, the gate electrode is switchable between an open and closed positions wherein when in an open positions, ions or products of ion reactions are allowed to pass and when in a closed positions, the ions or products of ion reactions are not allowed to pass. Such methods can also include controlling the amount of time when the gate is open and when the gate is closed. In some embodiments, the gate is configured such that it is continuously open.

In some embodiments, the method includes where the electrons are introduced via a filament, that is preferably either a tungsten or thoriated tungsten filament or are introduced with a $Y_2O_3$ cathode In some embodiments, the apparatus may include a controller configured to deliver voltages to said electrodes such that each electrode in said first plurality of electrodes is paired with an electrode in said second plurality of electrodes to form an electrode pair wherein each electrode in each electrode pair has the opposite polarity and is directly opposite across the intersection point of the other electrode in the electrode pair and whereby the RF fields generated between said intersection point and said first axial end of said second pathway by said first and second plurality of electrodes is in reverse phase to the RF fields generated between said intersection point and said second axial end of said second pathway.

In some embodiments, the electrons experience a defocusing effect as they approach said intersection point and a focusing effect once said electrons pass said intersection point.

In various embodiments, the apparatus also comprises a gate electrode at or disposed proximate to both the first and second axial end of said second pathway.

In various embodiments, the second pathway comprises lenses disposed at or proximate to said first or second axial ends for focusing said charged species.

In various embodiments, the second pathway contains disposed therein a laser source disposed at or proximate to the axial end opposite of said end for introduction of said charged species, said laser source for providing energy to said ions or said charged species.

In various embodiments, the laser source provides ultraviolet or infrared light.

In various embodiments, both of said axial ends of said second pathway comprise a charged species source, where only one of said charged species sources is operational at a time.

In various embodiments, the ions interact with said charged species.

In various embodiments, the interaction causes electron capture dissociation, electron transfer dissociation or proton transfer dissociation.

In various embodiments, a method for performing an ion reaction is disclosed including: providing a first pathway comprising a first axial end and a second axial end disposed at a distance from the first pathway axial end along a first central axis; providing a second pathway comprising a first axial end and a second axial end disposed at a distance from the second pathway axial end along a second central axis; said first and second central axis being substantially orthogonal to one another and having an intersection point; providing a first plurality of electrodes arranged in a multipole around said first central axis and disposed between said first axial end and said intersection point, said electrodes for guiding ions along a first portion of said first central axis; providing a second plurality of electrodes arranged in a multipole around said first central axis and disposed between said second axial end and said intersection point, said electrodes for guiding ions along a second portion of said first central axis; the first plurality of electrodes being separated from the second plurality of electrodes so as to form a gap transverse to said first central axis; providing a magnetic field parallel to said second central axis; providing RF voltages to said first and second plurality of electrodes; providing a controller for controlling the RF voltages so as to control the RF fields generated by said first and second plurality of electrodes; introducing a plurality of ions into either the first or second axial end of said first pathway along said first central axis; and introducing a charged species into the first or second axial end of the second pathway along the second central axis, said charged species travelling through said gap towards said intersection point.

In various embodiments, the method further comprises: providing a gate in or proximate to said first pathway at the axial end that is opposite of said axial end wherein said ions are introduced, said gate being switchable between an open and closed position wherein when in an open position, said ions or product of said ion reaction is allowed to pass and when in a closed position, said ions or product of said ion reactions is not allowed to pass. In various embodiments, the gate is open continuously.

In various embodiments, the method further comprises: controlling the lengths of time when said gate is open and when said gate is closed. In various embodiments, the ratio between the length of time between said open and closed positions is 8 milliseconds:2 milliseconds. In other embodiments, the ratio between the length of time between said open and closed positions is 3 milliseconds:7 milliseconds.

In various embodiments, the ions can be positively charged, the charged species can be electrons.

In various embodiments, one or more than one of the multipoles is a quadrupole.

In various embodiments, the method further comprises providing lenses disposed at or proximate to either said first or second axial ends of said second pathway for focusing said charged species.

In various embodiments, the method further comprises providing a laser source at or proximate to the axial end opposite the axial end in which the charged species is injected for providing energy to either said ions or charged species. In various embodiments, the laser source is ultraviolet or infrared.

In various embodiments, the ions interact with said charged species and can cause electron capture dissociation, electron transfer dissociation or proton transfer dissociation.

In various embodiments, the charged species is an anion.

In various embodiments, the ions are anions

In various embodiments, a device is disclosed that can also be utilized to inject photons using for example, laser beams, which can provide complementary dissociation techniques, such as UV photo dissociation and Infrared multiphoton dissociation (IRMPD).

In various embodiments, the electron beam may be turned off when the product ions are being ejected from the ECD devices when operating in continuous mode.

In various embodiments, the apparatus can operate in semi or quasi-continuous mode.

In various embodiments, the RF frequencies applied to the multipoles are in the range of 400 kHz to 1.2 MHz, preferably the frequency is 800 kHz.

In various embodiments, a reaction apparatus for ions is disclosed comprising: a first pathway comprising a first axial end and a second axial end disposed at a distance from the first pathway axial end along a first central axis; a second pathway comprising a first axial end and a second axial end disposed at a distance from the first axial end of the second pathway along a second central axis; said first and second central axis being substantially orthogonal to one another and having an intersection point; a first set of quadrupole electrodes arranged in a quadrupole orientation around said first central axis and disposed between said first axial end of said first pathway and said intersection point, said first set of electrodes for guiding ions along a first portion of said first central axis; a second set of quadrupole electrodes arranged in a quadrupole orientation around said first central axis and disposed between said second axial end of said first pathway and said intersection point, said second set of electrodes for guiding ions along a second portion of said first central axis; the first set of electrodes being separated from the second set of electrodes so as to form a gap transverse to said first central axis; a magnetic field generator that generates a magnetic field parallel to and along said second central axis; a voltage source for providing an RF voltage to said first and second sets of electrodes to generate an RF field; a controller for controlling said RF voltages; an ion source disposed at or proximate either the first or second axial end of said first pathway for introducing ions along said first central axis towards the other of said first or second axial end of the first pathway; and a charged species source disposed at or proximate either the first or second axial end of the second pathway for introducing a charged species along the second central axis, said charged species travelling through said gap towards said intersection point.

DETAILED DESCRIPTION OF EMBODIMENTS

Figure 1:
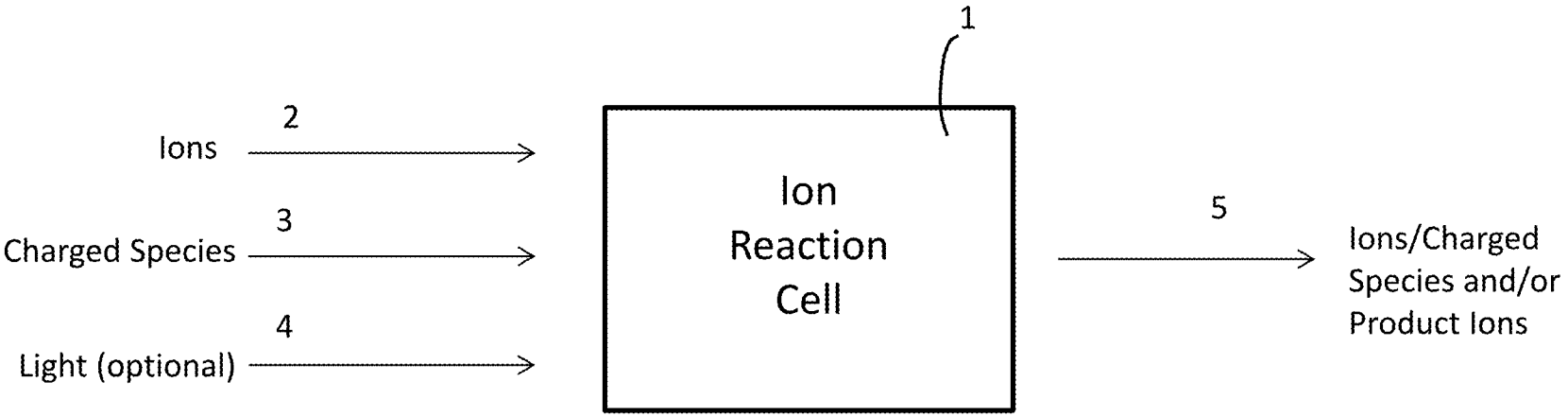
FIG. 1 depicts a schematic view of an implementation of an embodiment of the invention FIG. 2. depicts a cross sectional view in accordance with an embodiment of the invention.

Referring to FIG. 1 there is depicted a general schematic diagram of an embodiment of the invention. An ion reaction cell 1 has as inputs a series of reactants being, ions 2 and a charged species 3. Optionally, energy in the form of photons or light 4 is added. The light 4 can be obtained from a laser source and is preferably either light in the ultraviolet or infrared spectrum. The ions 2 can be any ion that is positively (cations) or negatively (anions) charged. The charged species 3 can be electrons or ions that are either positively or negatively charged. When the charged species are electrons, the electron source can be a filament such as a tungsten or thoriated tungsten filament or other electron source such as a $Y_2O_3$ cathode. In the reaction device, a cooling gas, such as helium (He) and nitrogen ($N_2$) are filled. The typical pressure of the cooling gas can be between $10^{-2}$ to $10^{-4}$ Torr.

The filament electron source is typically used because it is inexpensive but it is not as robust on oxygen residual gas. $Y_2O_3$ cathodes on the other hand are expensive electron sources but are more robust on oxygen so it is useful for de novo sequencing using radical-oxygen reaction. In operation, an electric current of 1 to 3 A is typically applied to heat the electron source, which produces 1 to 10 W heat power. A heat sink system of the electron source can be installed to keep the temperature of a utilized magnet, if present, lower than its Curie temperature, at which the magnetization of permanent magnet is lost. Other known methods of cooling the magnet can also be utilized.

Inside the ion reaction cell 1, the ions 2 and charged species 3 together with the optional addition of photons 4 all interact. Depending on the nature of reactants utilized, the interaction can cause a number of phenomenon to occur which result in the formation of product ions 5 which can then be extracted or ejected from the ion reaction cell 1 together with potentially other unreacted ions 2 and/or possibly charged species 3 as the circumstances dictate.

When the ions 2 are cations and the charged species 3 are electrons, the cations may capture the electrons and undergo electron capture dissociation in which the interaction between ions 2 and charged species 3 results in the formation of product ions 5 which are fragments of the original ions 2. When the ions 2 are cations and the charged species 3 is an anion, the interaction between the ions 2 and charged species 3 can be electron transfer dissociation in which electrons are transferred from the charged species 3 to the ions 2 which causes the ions 2 to fragment. The stream of species ejected from the ion reaction cell can consist of one or more or a mixture of the ions 2 or the product ions 5 or in some cases, the charged species 3.

In addition, for electron associated fragmentation, Hot ECD, electron ionization dissociation (EID), activated ions ECD (AI-ECD), electron detachment dissociation (EDD), negative ETD, and negative ECD can be implemented. For ECD, ETD and Hot ECD can be implemented when the ions 2 are cations while EID can be used if the ions 2 are anions. Proton transfer reactions can also be implemented if the charged species 3 are selected appropriately.

Figure 2:
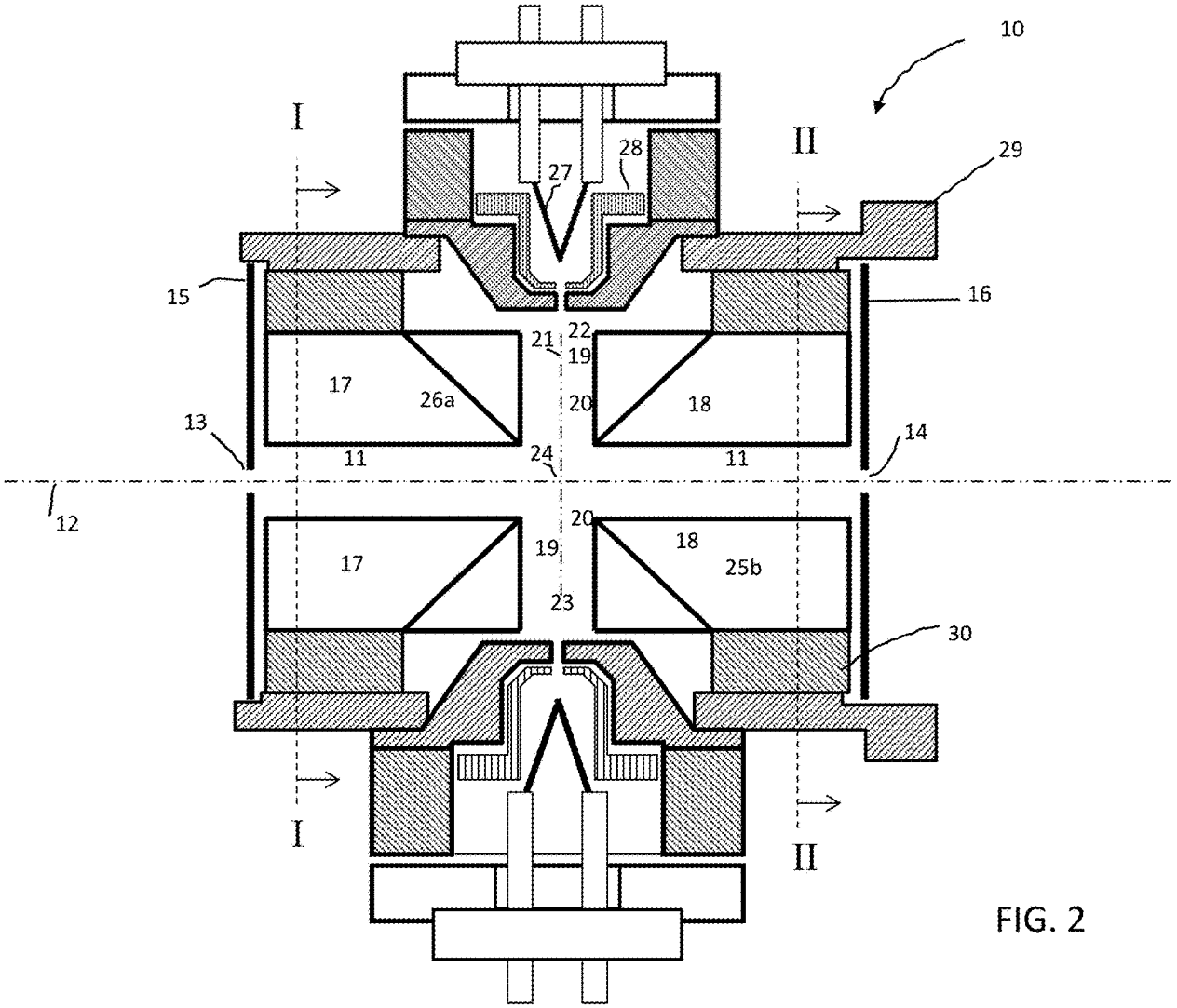
Figure 3B:
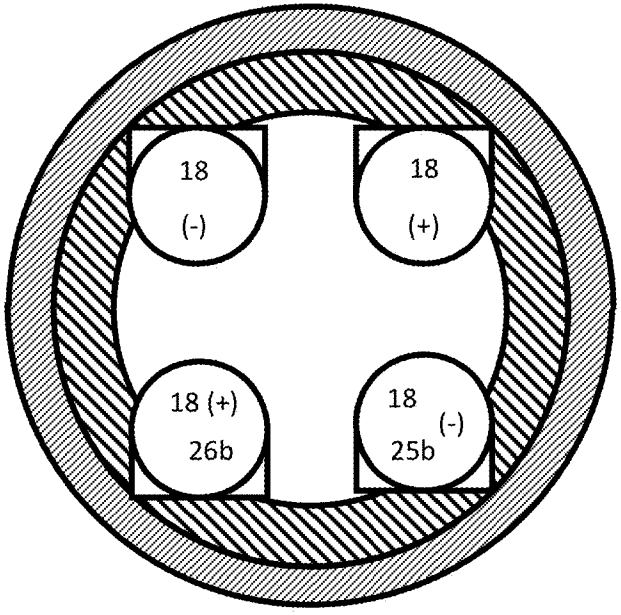
FIG. 3B depicts a cross sectional view of FIG. 2 along the lines II-II
Figure 3A:
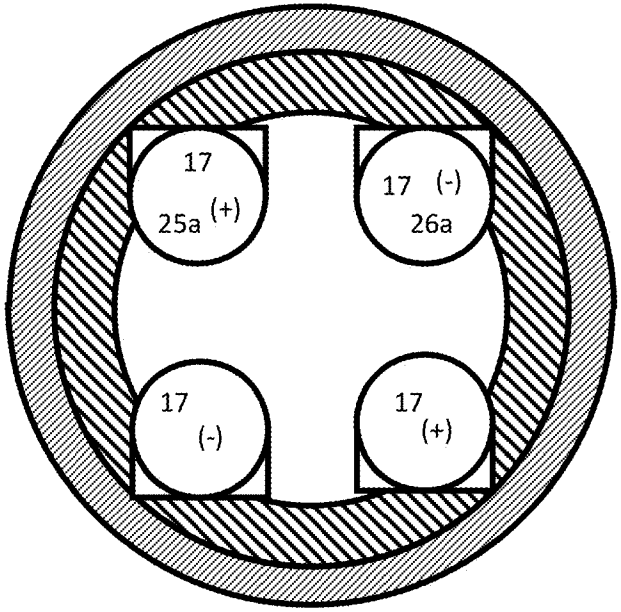
FIG. 3A depicts a cross sectional view of FIG. 2 along the lines I-I
Figure 18:
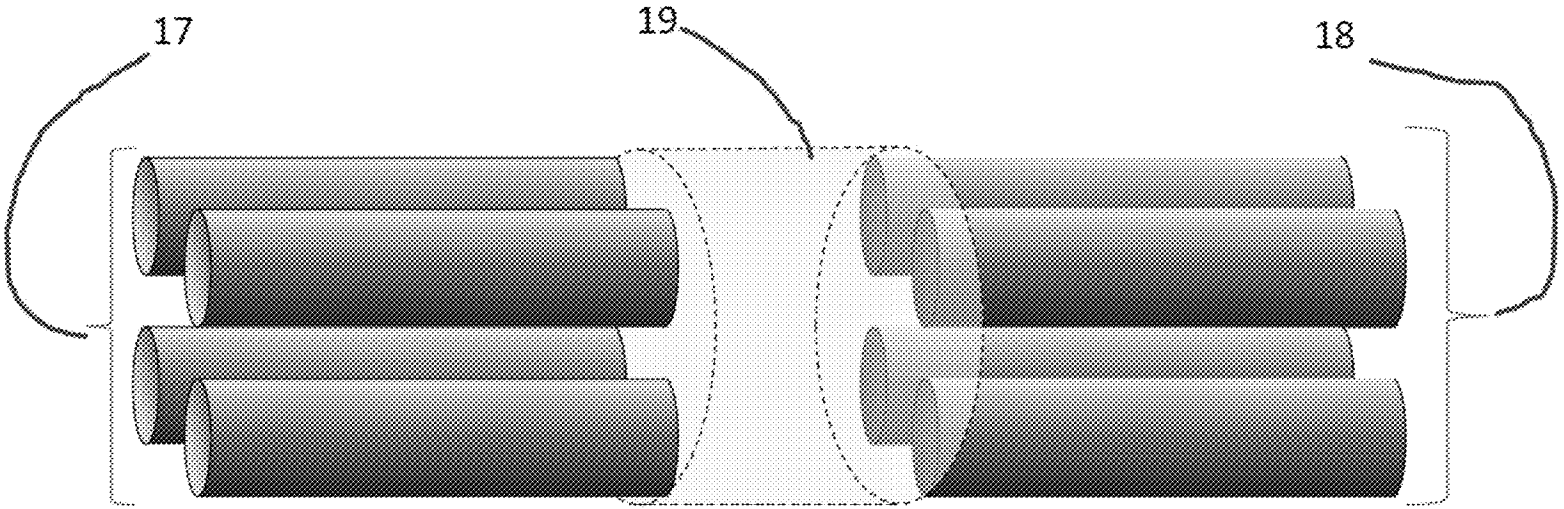
FIG. 18 depicts a view of an embodiment of the invention showing the gap

Now referring to FIG. 2, there is depicted a side view of an ion reaction apparatus 10 in accordance with an aspect of an embodiment of the invention. Shown as a cut out cross section, an outer cylindrical housing 29 and an inner cylindrical housing 30 surround a first pathway 11 having a first central axis 12 and a first axial end 13 and a second axial end 14. This pathway provides a path for ions 2 to enter into the ion reaction apparatus 10. At each end of the first pathway 11 is situated a gate electrode (15, 16). Gate electrode 15 allows ions 2 to enter into the apparatus 10 and gate electrode 16 controls the ejection of unreacted ions 2 or product ions 5 from the apparatus 10. The gate electrodes need not be situated directly at the axial end, and can be situated just outside and proximate to the axial end. As would be appreciated, due to the symmetrical nature of the device, the direction of the ions can be reversed with ions 2 entering through gate electrode 16 and exiting through gate electrode 15 if surrounding ion transport devices are configured appropriately. The apparatus 10 comprises a first set of quadrupole electrodes 17 mounted to the inner cylindrical housing 30, the electrodes 17 being arranged around the first central axis 12 in a quadrupole type arrangement. While quadrupoles are specifically embodied here, any arrangements of multipoles could also be utilized, including hexapoles, octapoles, etc. In the figure, only two of the four quadrupole electrodes are depicted, the other two electrodes are directly behind the depicted electrodes. Of the two electrodes depicted in the quadrupole electrodes 17, the electrodes have opposite polarity. These first set of quadrupole electrodes 17 are connected to a RF voltage source and controller (not shown) which serve to provide RF voltages to the electrodes to generate an RF field which can guide the ions 2 towards the first central axis 12, the midpoint of the quadrupoles. A second set of quadrupole electrodes 18 (only two being depicted, the other two being directly behind) also being mounted to the inner cylindrical housing 30 is situated at a slight distance away from the first set of quadrupole electrodes 17, the distance forming a mostly cylindrical shaped gap 19 between the first set 17 and second set 18 of electrodes. The first 17 and second 18 quadrupole share the same central axis 12 and the rods of the first set of quadrupoles 17 are in line with the second set of quadrupoles 18. The mostly cylindrical shaped gap is more easily visualized in FIG. 18 in which the gap has been exaggerated. While being depicted as a cylindrical shape, it would be appreciated that the shape of this gap is not important, but rather that there exists a gap between the first 17 and second 18 set of quadrupoles. For example, this shape could also be described as being a rectangular box shape, even though the quadrupoles have the same configuration. This second set of quadrupole electrodes 18 is also attached to an RF voltage source and controller (not shown) which serve to provide RF voltages to the electrodes to generate an RF field which can serve to guide ions 2, and/or product ions 5 towards the central axis 12, the midpoint of the second set 18 of quadrupole electrodes. The inner and outer cylindrical housing have a cut-out for insertion of a second pathway 20, having a second central axis 21 which has a first axial end 22 and second axial end 23. This second pathway 20 provides a path for the transport of a charged species 3 into the apparatus 10. The first and second pathway are substantially orthogonal to one another and meet at an intersection point 24, this intersection point being along the first 12 and second 21 central axis. More readily depicted in FIGS. 3A and 3B, which are cross sectional views taken at lines I-I and II-II of FIG. 2 respectively, each of the four electrodes in the first set of quadrupole electrodes 17 can be paired with one of the four electrodes in the second set of electrodes 18, such as for example wherein each electrode (25*a*, 25*b*) in each electrode pair has the opposite polarity and is directly opposite across the intersection point of the other electrode (25*b*, 25*a*) in the electrode pair, respectively. A similar relationship exists for the electrode pair with electrodes (26*a*, 26*b*). The same relationship applies to the two remaining electrodes in the first set of electrodes 17 pairing with the two remaining electrodes in the second set of electrodes 18. This orientation of the electrodes results in the RF fields that are generated between the intersection point 24 and the first axial end 22 of the second pathway 20 to be in reverse phase to the RF field generated between intersection point 24 and second axial end 23 of second pathway 20. Because of this configuration of the electrodes, no RF field is present on the center axis 21. The first axial end 22 of the second pathway 20 contains or has proximate to it, an electron filament 27 to be used to generate electrons for transmission into the second pathway 20 towards the intersection point 24. The first axial end 22 can also contain or have proximate to it, a suitable electrode gate 28 to control the entrance of electrons into the apparatus 10. A magnetic field source (not shown), such as a permanent magnet is configured to implement a magnetic field that is parallel to the second pathway 20. This magnetic field is useful when ECD, hot ECD, EID, EDD and negative ECD are being implemented where the charged species are electrons. When the charged species are reagent anions and include, for example the scenario where the reaction taking place is an ETD reaction, the magnetic field source and magnetic field are not needed. The presence of the gap may lead to leakage of ions through the sides of the cell in which the quadrupole RF field is weaker in the gap area. This can be mitigated by the usage of a blocking electrode which is typically a plate electrode positioned such that it prevents this leakage. The blocking electrodes are vertically aligned and spaced away from the electrodes. For the purpose of allowing the depiction of the interior of devices, such blocking electrodes are not depicted in the accompanying figures, with the exception of in FIG. 14 where a blocking electrode and vain 578 are shown. As would be understood, this blocking electrode is electrically connected to a suitable voltage source.

The RF frequencies applied to the quadrupoles are in the range of around 400 kHz to 1.2 MHz, preferably the RF frequency is around 800 kHz.

Figure 4:
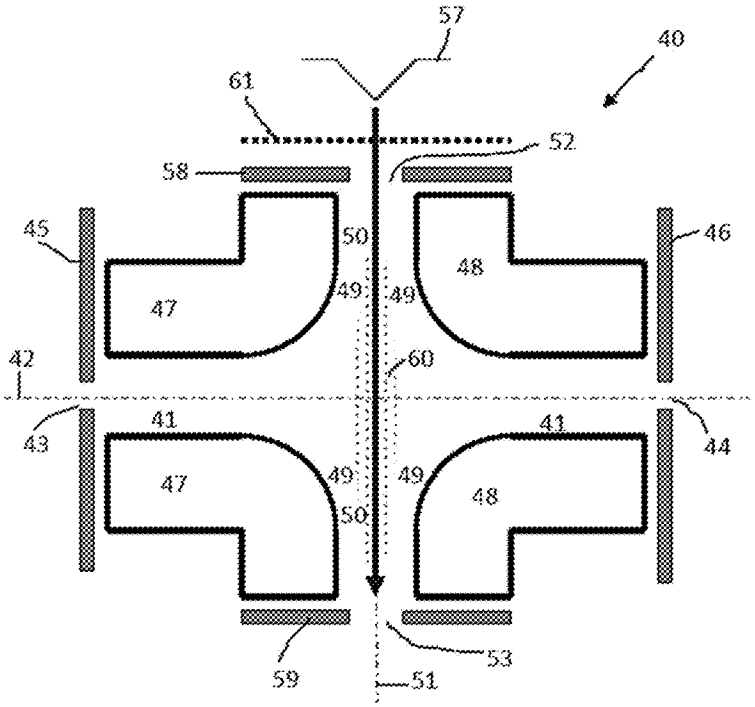
FIG. 4 depicts a simplified side view of an example of electron injection in accordance with an embodiment of the invention

Now referring to FIG. 4, a depiction of another embodiment in side view of the ion reaction device 40 is shown in which only a charged species 3, specifically electrons are injected. The ion reaction device 40 contains a first pathway 41 having a first central axis 42, the pathway 41 has a first axial end 43 and a second axial end 44. At each end of the first pathway 41 is situated an electrode gate (45, 46) which allows for the control of the entrance and ejection of ions from the ion reaction device 40. The apparatus 41 comprises a first set of quadrupole electrodes 47, generally L-shaped, arranged around the first central axis 42. In the figure, only two of the four quadrupole electrodes are depicted, the other two electrodes are directly behind the depicted electrodes. Of the two electrodes depicted in the quadrupole electrodes 47, the electrodes have opposite polarity. A second set of quadrupole electrodes 48 (only two being depicted, the other two being directly behind), also generally L-shaped is situated at a slight distance away from the first set of quadrupole electrodes 47, the distance forming a solid mostly cylindrical shaped gap 49 between the first set 47 and second set 48 of electrodes. Of the two electrodes depicted in the quadrupole electrodes 48, the electrodes have opposite polarity. The top depicted electrode in each of the first set 47 and second set 48 of quadrupole electrodes are opposite in polarity to one another. As would be understood by the skilled person, the two electrodes not shown of each set of quadrupole electrodes would have polarities consistent with quadrupole electrode polarities, such as for example the configuration shown in FIGS. 3A and 3B. A second pathway 50 has a second central axis 51 which has a first axial end 52 and second axial end 53. This second pathway provides a path for the transport of a charged species into the apparatus 40. This orientation of the electrodes results in the RF fields that are generated between the intersection point (of the first pathway 41 and second pathway 50) and the first axial end 52 of the second pathway 50 to be in reverse phase to the RF field generated between the intersection point (of the first pathway 41 and second pathway 50) and said second axial end 53 of said second pathway 50. The first axial end 52 of the second pathway 50 contains or has situated proximate to it, an electron filament 57 to be used to generate electrons 60 for transmission into the second pathway 50. The first axial end 52 can also contain or have situated near and proximate to it, a suitable electrode gate 58 to control the entrance of electrons 60 into the apparatus 40. Another gate electrode 59 is present or situated proximate to the second axial end 53 of the second pathway 50. A magnetic field generator (not shown) is positioned and oriented in such a way so as to create a magnetic field parallel to the second pathway. The direction of the magnetic field can be either from the first axial end 52 to the second axial end 53 or vice versa. This magnetic field is useful when ECD, hot ECD, EID, EDD and negative ECD are being implemented where the charged species are electrons. When the charged species are reagent anions and include, for example the scenario where the reaction taking place is an ETD reaction, the magnetic field source and magnetic field are not needed. A grid 61 can be positioned to act as a gate to switch the electrons 60 near or proximate to the electron filament 57. The RF fields causes the electrons 60 that are focused as they enter the apparatus 40 to become defocused as they approach the intersection point of the first pathway 41 and second pathway 50. As the electrons 60 pass the intersection point, the reverse in polarity of the RF fields causes the electron 60 to become focused again. This creates a more uniform distribution of electrons normal to the first pathway and increases the chances of ion-electron interactions in the apparatus 40 which can also result in better sensitivity. The electron beam creates a localized attractive potential.

Figure 5:
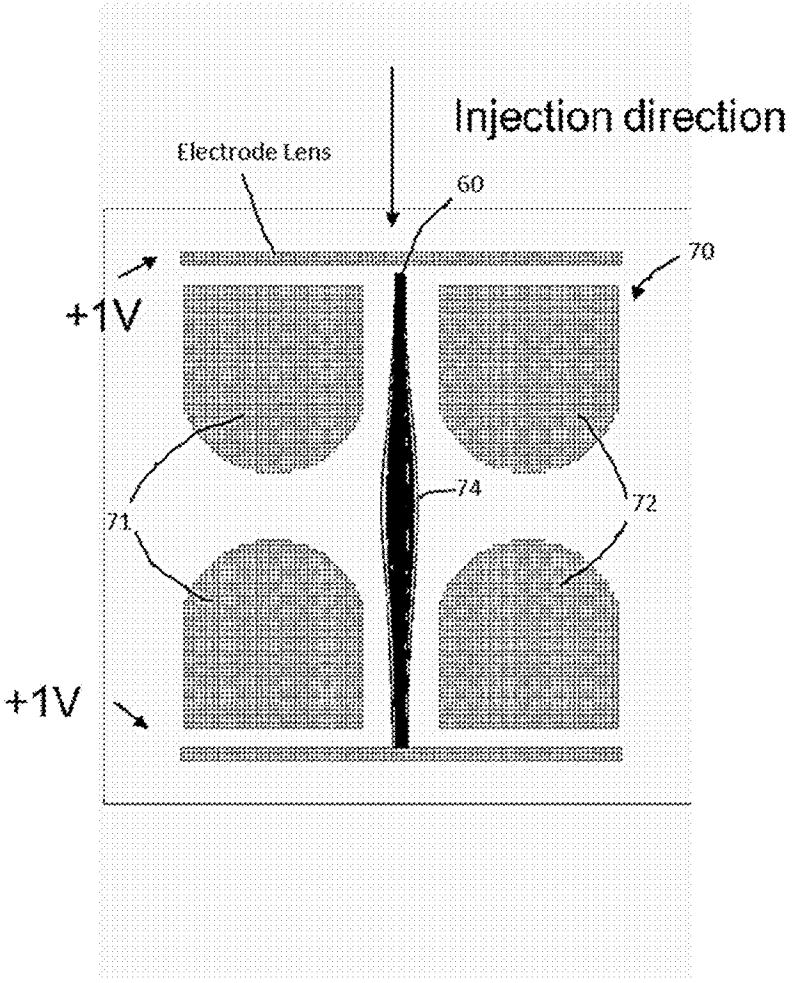
FIG. 5 depicts a simplified side view of the focusing and defocusing effect of the electron beam in accordance with one embodiment of the invention.

A clearer view of the electron defocusing effect is depicted in FIG. 5 in which the apparatus 70 is configured in a similar fashion to the apparatus 40 with first set of quadupole electrodes 71 and second set of quadrupole electrodes 72. Electron lens having a +1V potential are disposed at the entrance and exit of the electron beam path which are used to assist in focusing of the electron beam. Other parts are not repeated for brevity. The streams of electrons 60 into the apparatus 70 is seen to defocus as they approach the centre point 74, but are focused again as they pass the centre point. A magnetic field (not shown) of 0.1 T is aligned to be parallel to and along the path of electron direction. This magnetic field is useful when ECD, hot ECD, EID, EDD and negative ECD are being implemented where the charged species are electrons. When the charged species are reagent anions and include, for example the scenario where the reaction taking place is an ETD reaction, the magnetic field source and magnetic field are not needed. The RF field is 100V peak to peak and the electron beam energy is 0.2 eV at the center.

Figure 7:
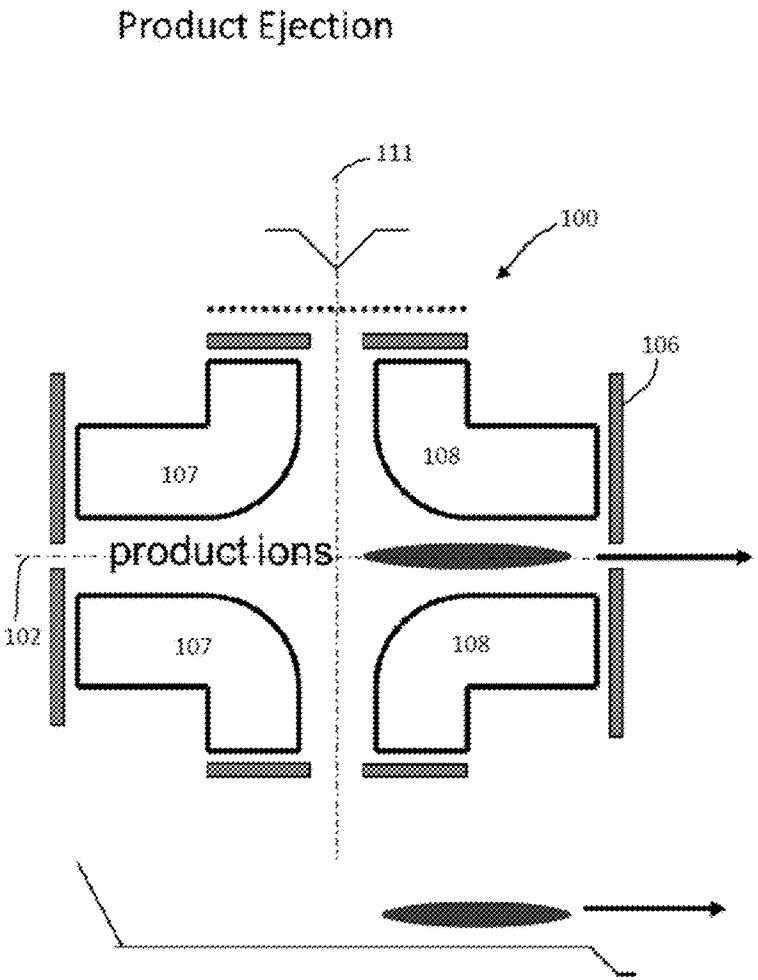
FIG. 7 depicts the ejection of ions or reaction products of an ion reaction from the apparatus in accordance with an embodiment of the invention.
Figure 6:
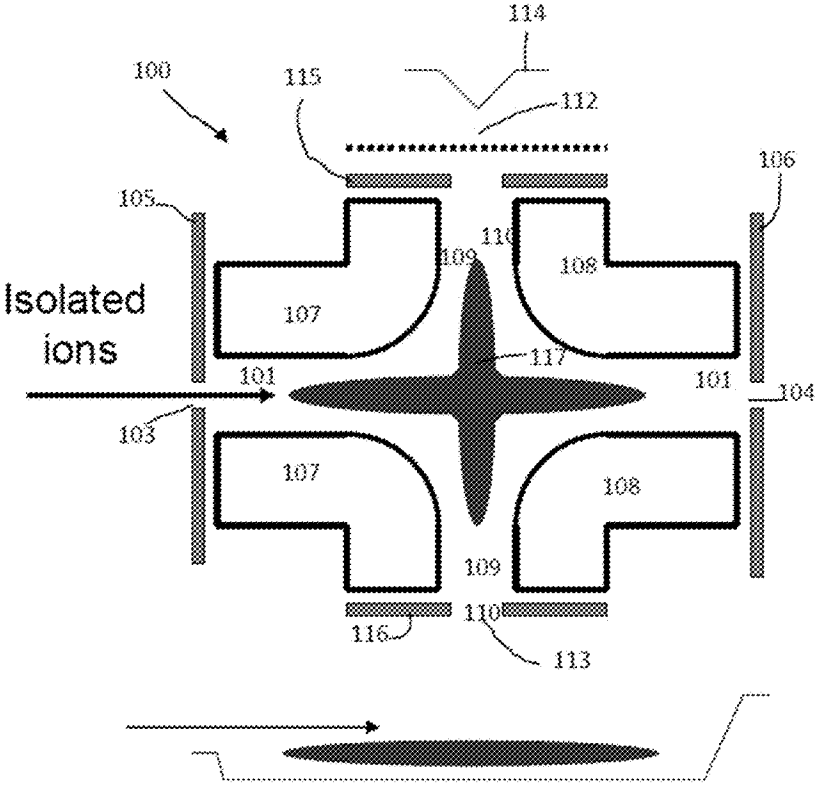
FIG. 6 depicts the injection and trapping of ions into the apparatus in accordance with one embodiment of the invention.

FIGS. 6 and 7 depicts a side view of the ion trap effect generated by an apparatus 100 in accordance with an embodiment of the invention in a batch type manner. A first pathway 101 comprising a first axial end 103 and a second axial end 104 provides for a flow path of ions to be injected from the first axial end 103. A second pathway 110 also comprising a first axial end 112 and a second axial end 113 provides a pathway for an electron beam that is generated by a filament 114. One set of quadrupole electrodes 107 (only two being depicted, the other two being directly behind) attached to an appropriate set of RF voltages sources is directed and serves to guide ions to a midpoint within the quadrupole electrodes 107 to the central axis 102. A second set of quadrupole electrodes 108 (only two being depicted, the other two being directly behind) is situated at a slight distance away from the first set of quadrupole electrodes 107, the distance between the first 107 and second 108 set of quadrupole electrodes forming a gap 109 between the sets of electrodes. This second set of quadrupole electrodes 108 serves to guide ions to a midpoint between the quadrupole electrodes 108 to a central axis 102. Of the two electrodes depicted in the quadrupole electrodes 107, the electrodes have opposite polarity. Of the two electrodes depicted in the quadrupole electrodes 108, the electrodes have opposite polarity. The top depicted electrode in each of the first set 107 and second set 108 of quadrupole electrodes are opposite in polarity to one another. As would be understood by the skilled person, the two electrodes not shown of each set of quadrupole electrodes would have polarities consistent with quadrupole electrode polarities, such as for example the configuration shown in FIGS. 3A and 3B. A magnetic field generator (not shown) creates a magnetic field that is oriented parallel to the direction of the second pathway and in line with the second central axis 111. This magnetic field is useful when ECD, hot ECD, EID, EDD and negative ECD are being implemented where the charged species are electrons. When the charged species are reagent anions and include, for example the scenario where the reaction taking place is an ETD reaction, the magnetic field source and magnetic field are not needed. Entrance gate electrode 105 and exit lens gate electrode 106 control the inflow and outflow of ions into the apparatus 100. In this embodiment, entrance lens gate electrode 105 is set at a potential which allows the inflow of ions into the apparatus 100, whereas the exit lens gate electrode 106 has a high enough potential that prevents the out flow of ions from the apparatus. The second pathway also contains or has situated proximate to it, gate electrodes 115, 116 which are positively biased which prevent the outflow of ions through the axial ends 112, 113 of the second pathway 110. In this embodiment, the filament 114 is initially turned off as the ions are injected and no charged species enters the apparatus 100 via the second pathway 110. In this way, the apparatus 100 functions as an ion trap where ions that are injected are accumulated at the intersection point between the first 101 and second pathways 110. When sufficient ions have been accumulated, the potential of gating electrode 105 is increased so as to prevent the inflow of ions into the apparatus 100, thereby preventing the entrance and exit of ions. Filament 114 can then be turned on and the potential of gate electrode 115 can be reduced to allow the in flow of electrons 117 into the apparatus 100. Upon this, electrons may interact with the ions and undergo ECD resulting in fragmentation into product ions. Once sufficient fragmentation has occurred, the filament 114 can be turned off, the potential of gate electrode 115 can be increased and the potential of gate electrode 106 can be lowered to allow the exit of product ions through the second axial end 104 as depicted in FIG. 7. A cooling gas, such as for example helium or nitrogen gas may be introduced in the device 100 to obtain more efficient trapping. Each of the electrodes from the first 107 and second 108 quadrupole has a first portion of the electrode which is substantially oriented parallel to the first central axis 102 whereas the second portion is substantially oriented parallel to the second central axis. As each portion of each electrode has the same polarity for a given electrode, the electrodes collectively can act as a trap directing the ions to both the central axis 102 and the central axis 111. In this manner, the apparatus 100 acts as a two-dimensional trap, or more precisely, a linear trap in two directions. Though depicted in FIG. 6 as having a smooth rounded transition between the first portion and the second portion, other configurations such as sharp corners can also be utilized. Listed below each apparatus in FIGS. 6 and 7 are graphs of spatial potentials for positive ions in the horizontal direction in the apparatus along the central axis 102. In FIG. 6, the potential at the entrance is approximately equal to that of the incoming isolated ions and therefor allows ions to pass through to enter the apparatus, the potential present at the exit is higher than that of the isolated ions entering the apparatus and therefore the ions do not exit through the right of the apparatus and become trapped. In FIG. 7, the entrance potential is higher thereby preventing the ions from exiting back through the entrance, whereas the potential in the exit is lower than that of the product ions, thereby allowing the ions to leave the apparatus.

Figure 8:
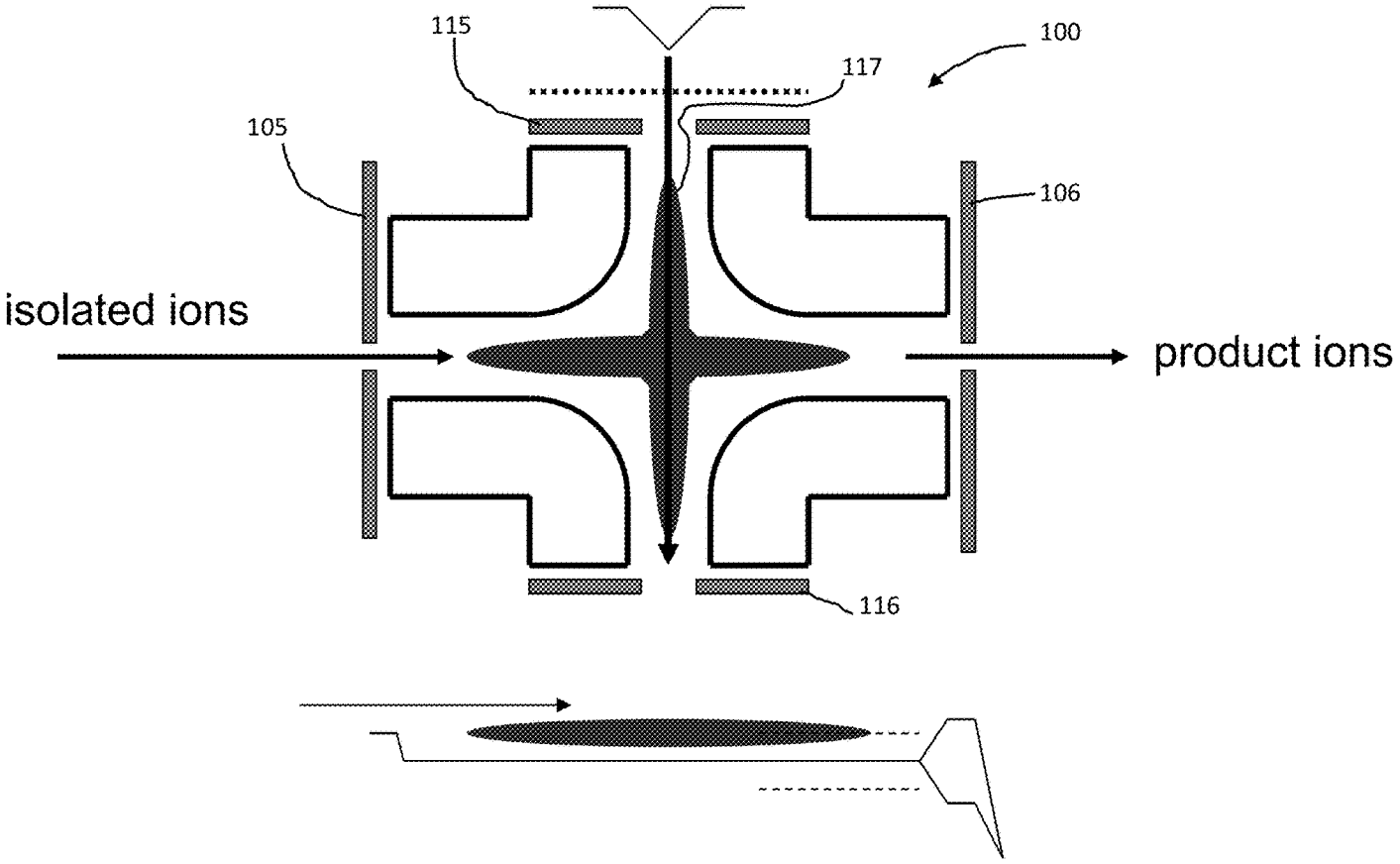
FIG. 8 depicts a continuous mode operation of an embodiment of the invention where ions and electrons are continuously injected and a stream of product ion as a result of ion-electron interactions is continuously ejected.

FIG. 8 depicts a side view of the operation of apparatus 100 in a semi-continuous mode in which ions continuously enter through gate 105 and electrons 117 enter continuously through gate 115. The interactions between ions and electrons 117 can cause ECD which results in fragmentation and the formation of product ions. These product ions as well as unreacted ions are extracted from the apparatus through gate electrode 106 in a semi-continuous fashion in which the gate electrode 106 switches between an open and closed position. When in a closed position, the potential located in the gate electrode is higher than that of the ions contained within in the apparatus, thereby causing ions to accumulate and allow increased residence and reaction time so that an ECD reaction can take place. When ions are to be extracted, the gate electrode 106 is opened by lowering the potential in the gate allowing the product ions to be removed. Listed below the apparatus 100 in FIG. 8 is a horizontal spatial representation of the potential for positive ions which show the exit potential oscillating between a high potential and a low potential which represents closed and opened positions of the gate 106.

Figure 9:
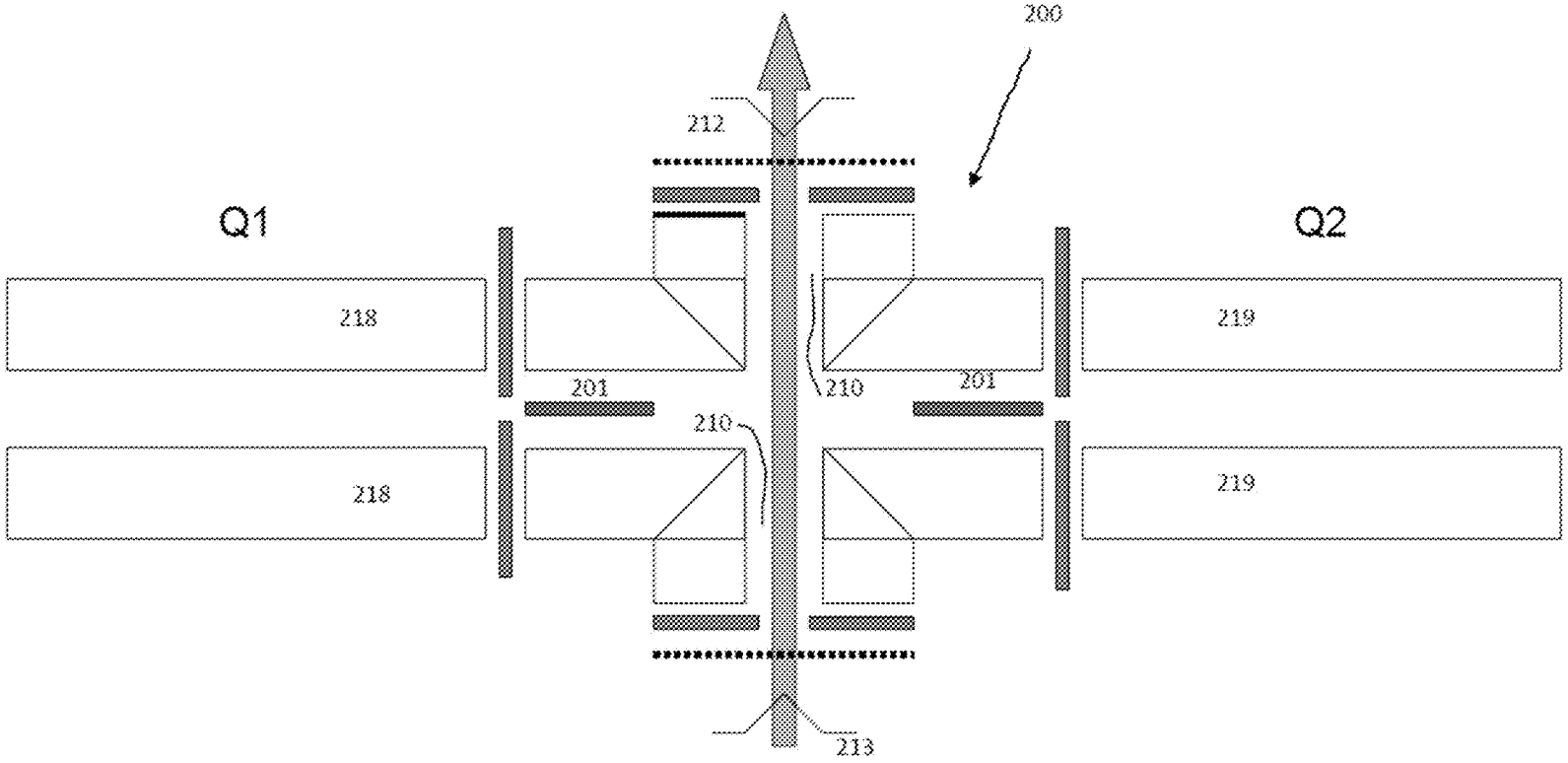
FIG. 9 depicts a cross sectional view of an embodiment of the invention illustrating the orientation of a magnetic field.

Now referring to FIG. 9, the apparatus 200 in accordance with an embodiment of the invention is depicted in side view inserted in series in between two quadrupole filters. Quadrupole filter Q1 having quadrupole rods 218 is situated upstream of the apparatus 200 and serves to trap/guide/etc. ions and provides a source of ions at the entrance of the apparatus 200. Quadrupole Q2, having quadrupole rods 219 is situated downstream of the apparatus 200 can serve to receive product ions and unreacted ions and either trap/guide/etc. in the quadrupole for further analysis or processing. The apparatus is similar to the apparatus described previously and will not be described in detail for brevity. The apparatus 200 has first pathway 201 and second pathway 210. The apparatus 200 contains two filaments, each one disposed at either the first axial end 212 or second axial end 213 of the second pathway 210. This configuration allows for the independent operation of the filaments so that if one filament is being used and suddenly becomes inoperative, the other filament can then be used as a spare and activated such that there is no or minimal downtime. While specifically exemplifying the use of additional quadrupoles, it would be appreciated that other types of devices can be situated either before or after the apparatus in accordance with the present teachings. For example, the devices can include various ion guides, filters, traps, ion mobility devices, including differential mobility and field-asymmetric ion mobility spectrometers and other mass spectrometer devices such as Time-of-Flight mass spectrometers.

Figure 11:
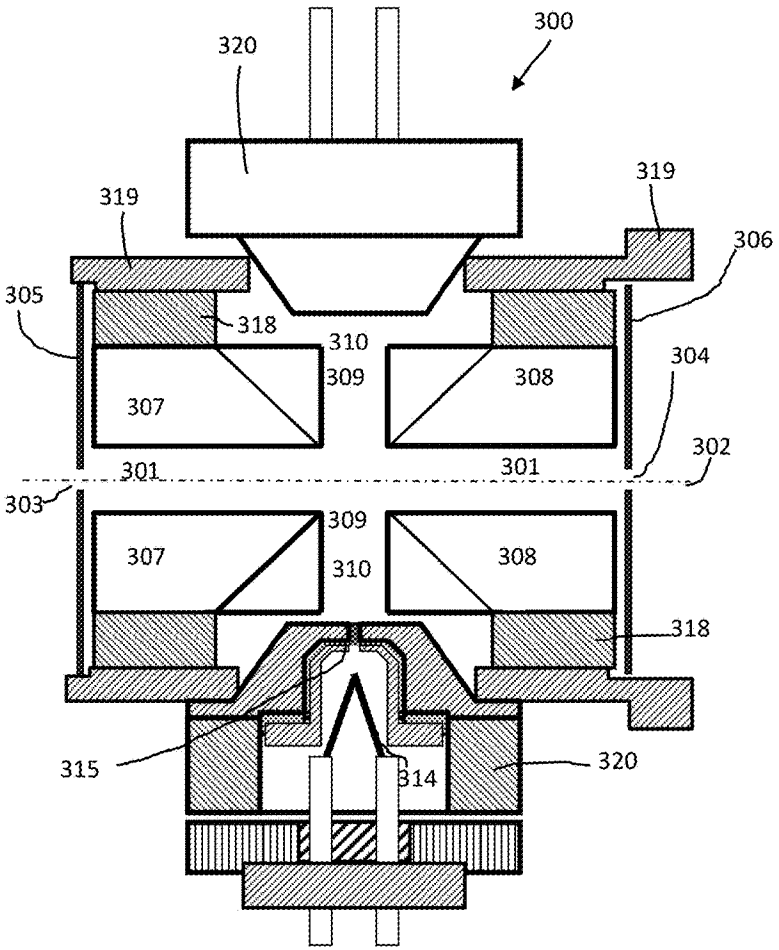
FIG. 11 depicts another cross sectional view of an embodiment of the invention.
Figure 10:
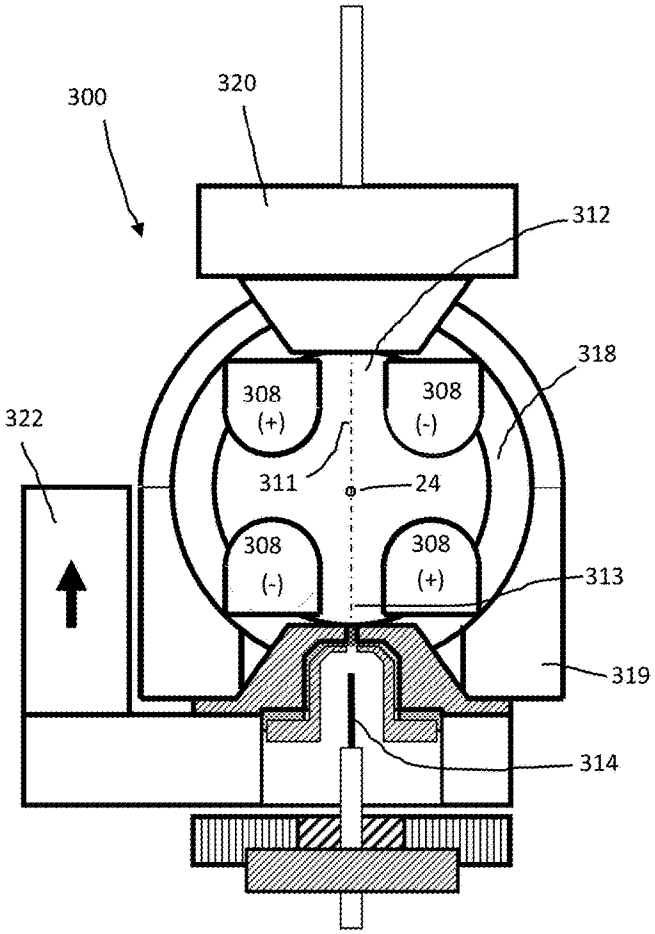
FIG. 10 depicts a cross sectional view of an embodiment of the invention.

Now referring to FIGS. 10 and 11, another embodiment of apparatus 300 is depicted. FIG. 11 shows as a partial cut out cross section, an inner cylindrical housing 318 and outer semi-cylindrical housing 319 which surround a first pathway 301 having a first central axis 302 and also having a first axial end 303 and a second axial end 304. This pathway 301 provides a path for ions to enter into the ion reaction apparatus 300. At each end of the pathway 301 is situated an electrode gate (305, 306). Electrode gate 305 allows ions to enter into the apparatus 300 and electrode gate 306 controls the ejection of ions or product ions or unreacted ions from the apparatus 300. The apparatus 300 comprises a first set of quadrupole electrodes 307 mounted to the inner cylindrical housing 318, the electrodes 307 being arranged around the first central axis 302. In the figure, only two of the four quadrupole electrodes are depicted, the other two electrodes are directly behind the depicted electrodes. Of the two electrodes depicted in the quadrupole electrodes 307, the electrodes have opposite polarity. These first set of quadrupole electrodes 307 are attached to a RF voltage source and controller (not shown) which serve to generate RF fields that can guide the ions to the first central axis 302, the midpoint of the quadrupoles 307. A second set of quadrupole electrodes 308 (only two being depicted in FIG. 11, the other two being directly behind and more readily depicted in FIG. 10) also being mounted to the inner cylindrical housing 318 is situated at a slight distance away from the first set of quadrupole electrodes 307, the distance forming a gap 309 between the first set 307 and second set 308 of electrodes. This second set of quadrupole electrodes 308 is also connected to a suitable RF voltage source whose purpose is to generate an RF filed that can serve to guide ions and/or product ions towards the central axis 302, the midpoint of the second set 308 of quadrupole electrodes. The inner 318 and outer cylindrical housing 319 have a cut-out into which a filament housing 320 can be inserted. This cut-out allows for the establishment of a second pathway 310, having a second central axis 311 which has a first axial end 312 and second axial end 313. This second pathway 310 provides a path for the transport of electrons into the apparatus 300. The first 301 and second pathway 310 are substantially orthogonal to one another and meet at an intersection point 24. The configuration and polarity of the electrodes is more readily seen in FIG. 10. Filament housings 320 are disposed at or proximate the first axial end and second axial end that contain suitable apertures 315 for flow of electrons. Contained within the housings is a filament 314 for generating electrons. A magnetic field is generated by magnet 322 that is parallel and in line with the central axis 311 of the second pathway 310. This magnetic field is useful when ECD, hot ECD, EID, EDD and negative ECD are being implemented where the charged species are electrons. When the charged species are reagent anions and include, for example the scenario where the reaction taking place is an ETD reaction, the magnetic field source and magnetic field are not needed.

In another embodiment, one of the two electron filament housings can be removed and replaced with a vacuum view port. An infrared laser can then be mounted to inject infrared light in a direction opposite to the entering electrons. The IR laser is used to heat the precursor ions or product ions to get better dissociation efficiency. In another embodiment, the IR laser can be replaced with a UV laser. The UV laser can be used for photo dissociation of the precursor ions. This alternative dissociation technique provides complementary information of ion structure.

In yet another embodiment, one or both of the electron sources in the apparatus can be replaced with an ion source, preferably an anion source. Such an embodiment is useful for ion-ion reactions in which ETD and PTR can be performed.

Figure 12:
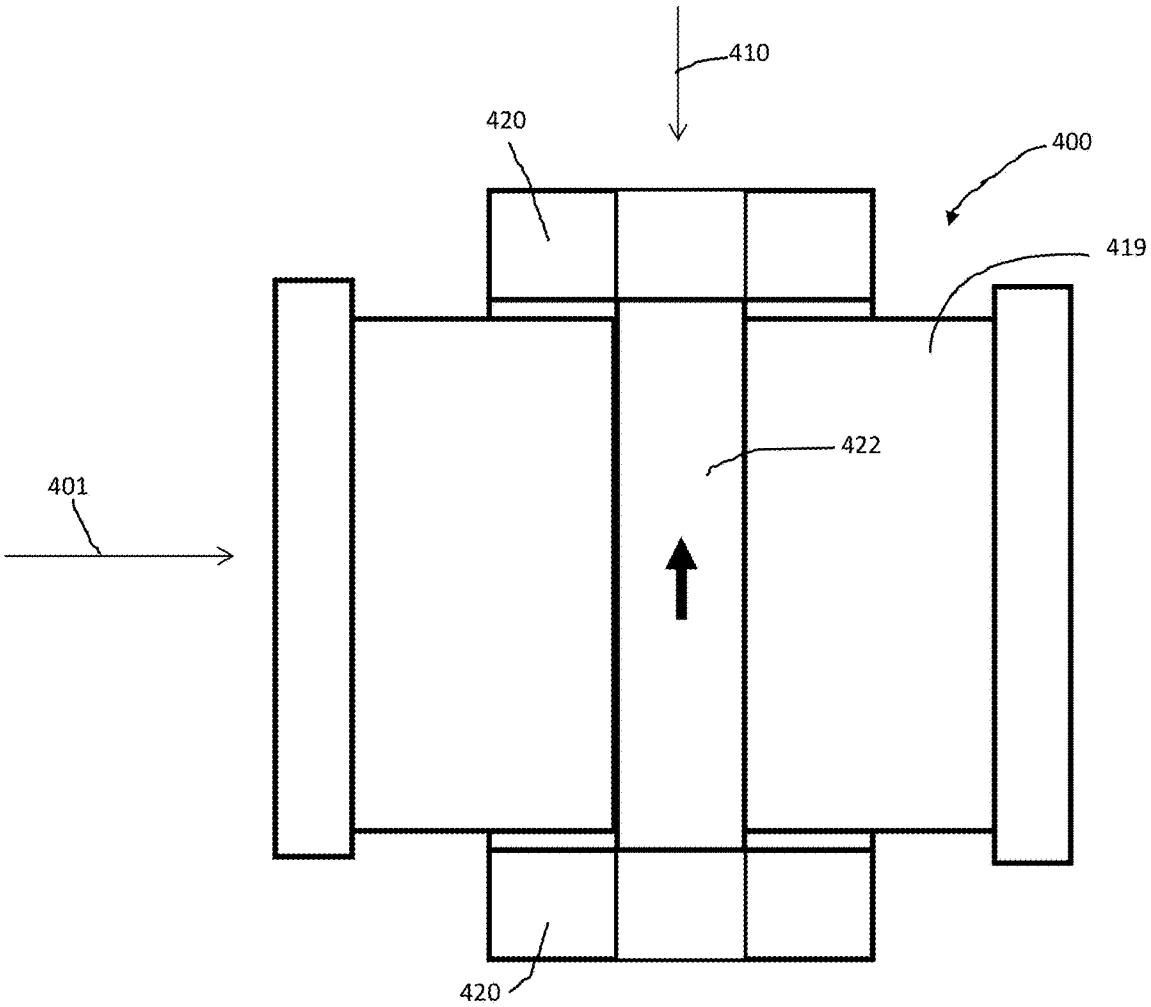
FIG. 12 depicts a rear view of the embodiment show in FIG. 11 showing one possible location of a magnet.

FIG. 12 depicts a back side view of an apparatus 400 representative of the embodiments shown in FIG. 10 having an outer cylindrical housing 419, a flow path for the first pathway 401 and another flow path for the second pathway 410. Filament housings 420 are inserted into apertures in the cylindrical housing 419. A permanent magnet 422 creates a magnetic field parallel to and in line with the second pathway 410. The magnetic field can also be generated by any other magnetic field generating source and can also include an electromagnetic, a neodymium magnet or the like that functions to generate a field parallel to and in line with the central axis of the second pathway. The magnetic flux density can be any density able to implement the magnetic field to cause focusing of the electron beam and can range, for example, up to 1.5 T or higher, but preferably about 0.1 to 1.0 T. Magnets with higher density can be positioned further away from the electrode pair.

Figure 13:
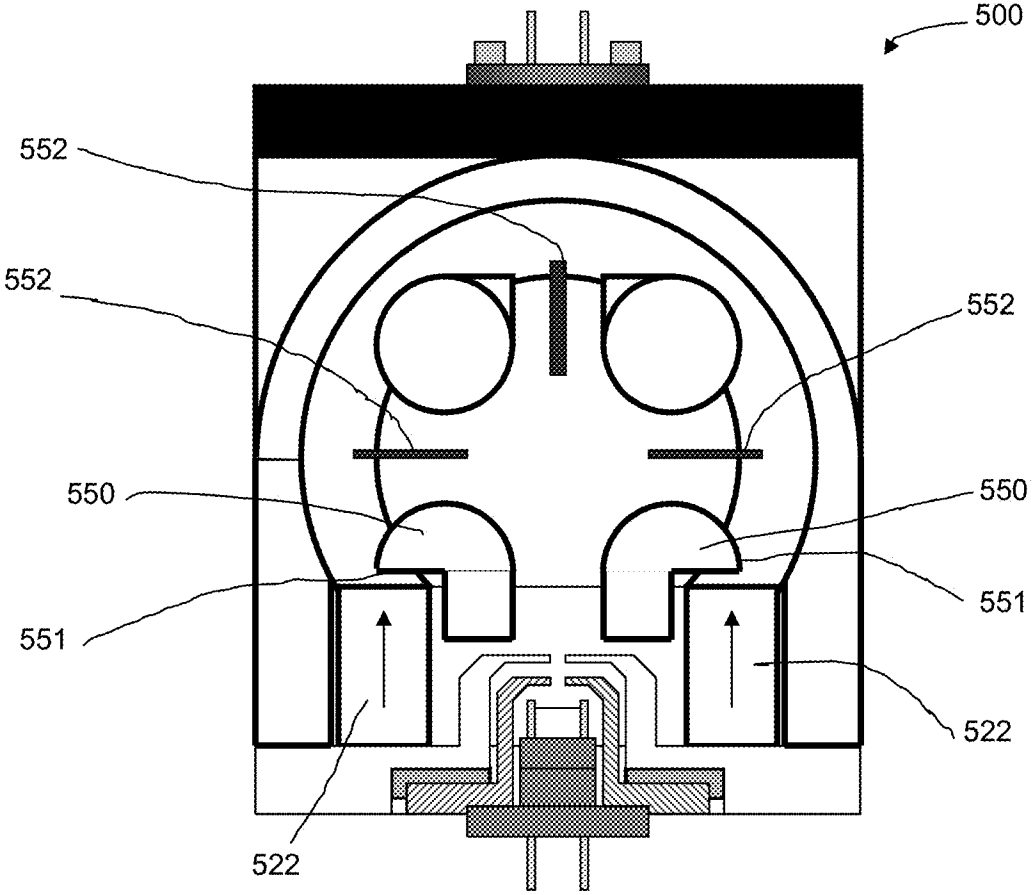
FIG. 13 depicts a cross-sectional view of an embodiment of the invention showing the location of a series of magnets in an embodiment of the invention.

FIG. 13 depicts a cross sectional view of an embodiment of an apparatus 500 similar to the apparatus 300 depicted in FIGS. 10 and 11. The apparatus 500 is depicted with a differently shaped bottom two electrodes 550 of each set of quadrupoles. The bottom two electrodes have a notch or detent 551 into which magnets can be situated. Other differences include the location of the magnetic sources 522 and the addition of optional vanes 552. The placement of these magnets 522 creates a magnetic field parallel to the direction of electron flow similar to the fields described in the previously discussed embodiments. The electrodes can encompass any number of possible shapes. Conventional multipole electrode shapes including cylindrical rods are within the scope of the present teachings as well as other shapes known in the art such as those with hyperbolic cross sections. The vanes 552 assist in controlling the ion position in the ion injection pathway line. When positive bias is applied to the vanes 552 through appropriate means, the ions are preferentially trapped in the charged species path to allow for a better ion-charged species interaction.

Figure 14:
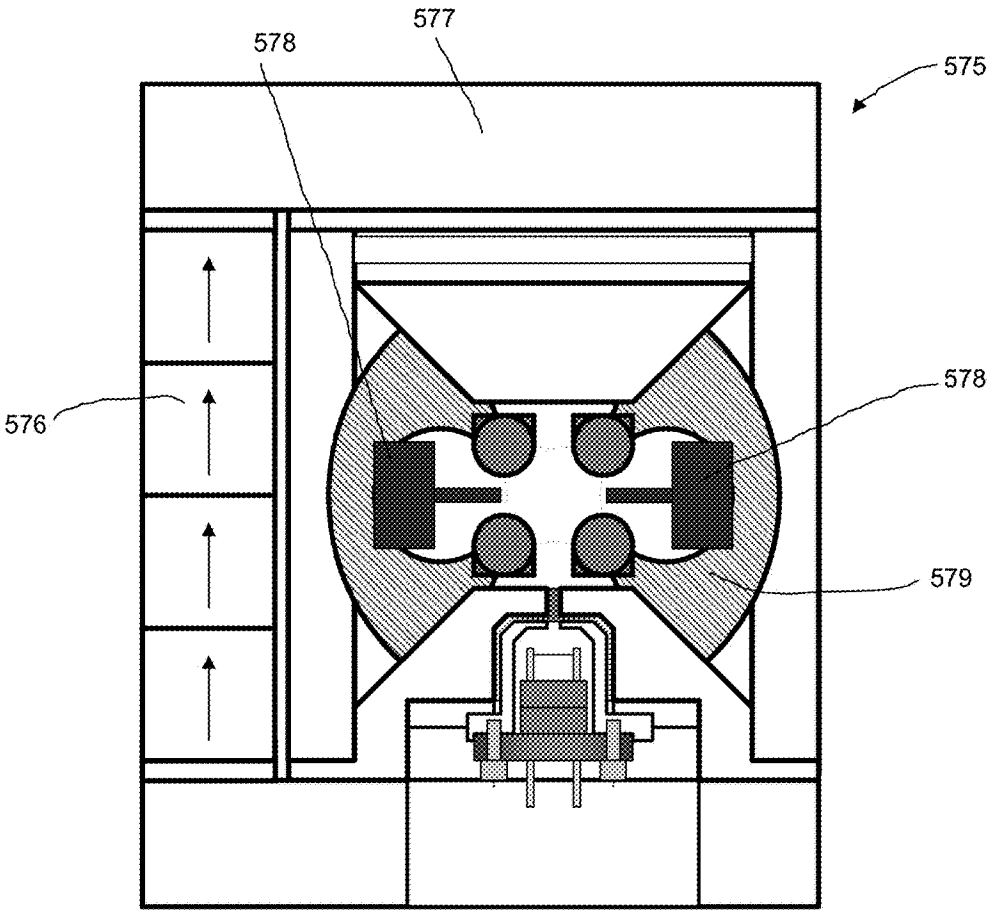
FIG. 14 depicts a cross-sectional view of another embodiment of the invention.

FIG. 14 depicts a cross section view of yet another embodiment of an apparatus 575 similar to apparatus 300 depicted in FIGS. 10 and 11. In this embodiment, neodymium magnet 576 with return yoke 577 is utilized to generate a magnetic field and blocking electrode plate and vanes 578 are mounted accordingly to cylindrical housing 579, with other elements being similarly arranged to the previously described embodiments.

Figure 15:
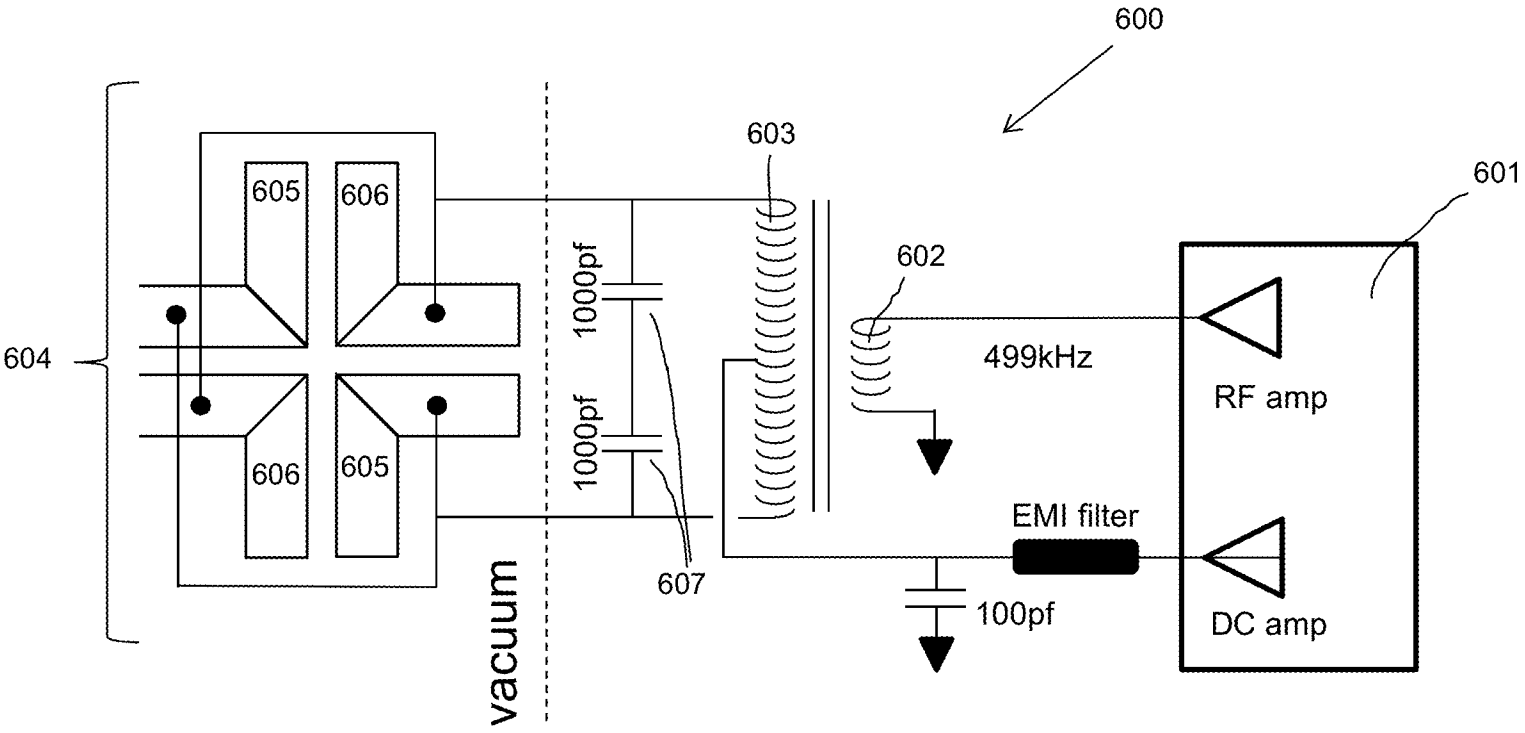
FIG. 15 depicts a schematic view of a circuit that can be used to generate RF fields in accordance with an embodiment of the invention.

FIG. 15 depicts an example of an RF circuit 600 that can be used to generate radial trapping RF fields in one of both of the sets of quadrupoles described in an example of an embodiment. The one set of the quadrupole electrodes 604 is split into two pairs of electrodes, one pair of electrodes 605 having an opposite polarity to the other pair of electrodes 606. The circuit comprises a generator 601, a primary transformer 602, a secondary transformer 603 and capacitors 607.

In various embodiments, electron control optics and ion control optics are completely separated, so independent operations on both charged particles are possible. For electrons, electron energy can be controlled by the potential difference between the electron source and the intersection point between the ion pathway and the charged species pathway. The charged species pathway can be controlled in an ON/OFF fashion by use of a gate electrode. Lens can be positioned at or proximate either axial end of the second pathway and when positively biased, cause the charged species, when such species are electrons, to focus. Ions which are introduced through the other pathway are stable near theses lens since they are biased positively.

In another aspect of an embodiment, if EDD application is required when the ions are negative and the electron beam has energy of about 10 eV, the polarity of lens electrodes and gate should be inverted.

The present teachings may also be extended to the introduction of a third pathway. The third pathway is orthogonal to each of the first and second pathways. Such a pathway would be visualized in for example, FIG. 2, as a pathway that is coming out of the figure towards the viewer. This third pathway has first and second ends and a central axis, the central axis being orthogonal to the first and second central axis of the first and second pathways, respectively and meeting at the intersection point. The third pathway can allow the introduction of and is configured in a similar fashion to the second pathway and its purpose can be to provide reactants such as charged species (anions, cations or electrons, etc.) or energy in the form of photons including infrared or ultraviolet light into the reaction cell. For example, each end of the third pathway may comprise or have situated proximate to it, an electron filament housings from which electrons may be generated and directed through the third pathway from the end towards the intersection point. The third pathway may also have situated at each or both ends, appropriate gating electrodes attached to suitable RF voltages that prevent the exit of ions from the ends of the third pathway. Appropriate grids may also be positioned at or proximate the electron filament to function as gates to switch on or off the electron source to control the entrance of electrons into the ion path. In this type of configuration, three or four electron sources are therefore appropriately mounted around the first pathway and each can be used separately to introduce electrons into the reaction cell. As would be understood, the magnetic field generator would need to be modified or repositioned in such a manner to allow for the aligning of the magnetic field along the central axis of the pathway being utilized at any given moment in time. In other embodiments, one or more of the electron sources can be replaced with a suitable vacuum view port into which a light source, including a laser source may be mounted. The light/laser source may comprise an IR or UV laser.

Figure 19:
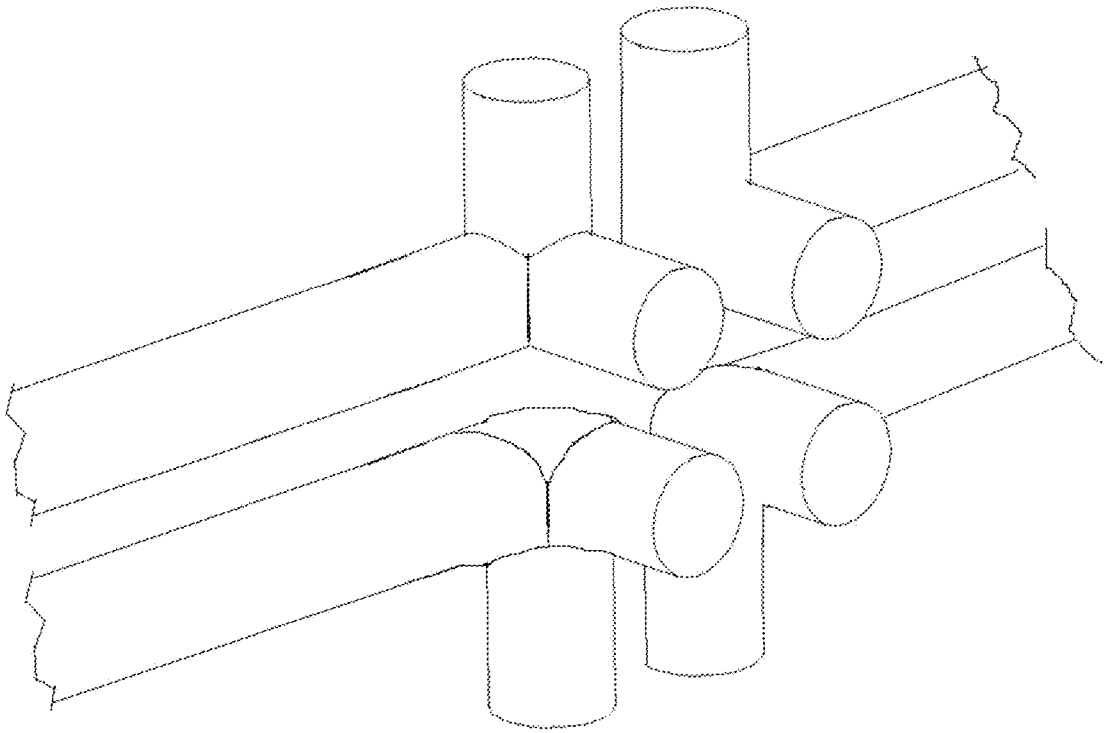
FIG. 19 depicts a view of four electrodes of an embodiment of the invention.

When used in a three pathway configuration, each of the quadrupole electrodes can be modified such that the electrodes comprise three portions, each of the portions comprising a finger that is substantially parallel to one of the first, second or third pathway, with the three fingers being substantially orthogonal to one another. In another embodiment, the three fingers are three circular rods which meet together at a corner, such as that depicted in FIG. 19 in which two electrodes of each of the first and second set of quadrupoles is depicted. As would be appreciated for a three pathway configuration, the other two electrodes for each of the first and second set of quadrupoles would generally be L-shaped comprising only two fingers.

In other embodiments, the three pathway configuration can be extended to a four pathway configuration in which the L-shaped electrodes are replaced with another set of three fingered electrodes. In this manner, four three-fingered electrodes would be additionally present that would mirror the four electrodes already depicted in FIG. 19. Such a configuration would provide four pathways for introduction of reactants or energy to the cell.

In another embodiment, the electron gate may be closed or the electron beam generating the electrons may be turned off when the product ions and other ions are being ejected from the apparatus.

EXAMPLES

Continuous Mode

Figure 16:
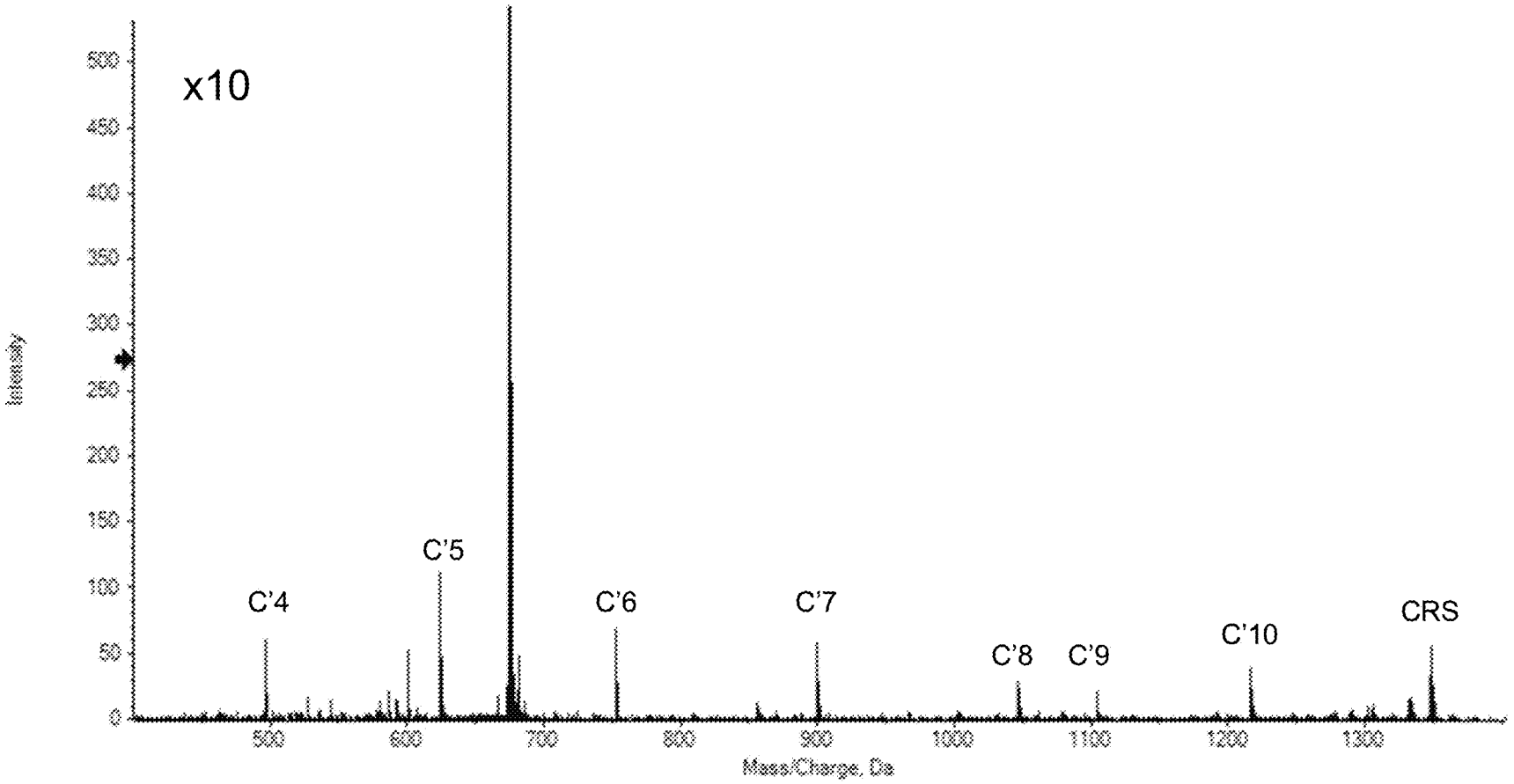
FIG. 16 depicts a mass spectrum of doubly protonated Substance P obtained in the continuous mode operation of an apparatus in accordance with an embodiment of the invention.

In a continuous mode operation, a stream of ions is introduced continuously into the reaction apparatus at one end and electrons are introduced into the reaction apparatus in a stream that is orthogonal to the stream of ions. Gates situated at the entrance and exit of both the ion pathway and the electron pathway are continuously open. Upon interaction of the ions with the electrons, some of the ions undergo ECD and fragment. The product ions which include the fragmented portions, as well as unfragmented portions are then continuously extracted from the reaction apparatus to be subsequently processed and analyzed using an ion detector. FIG. 16 depicts a mass spectra obtained from such a mode of operation for the neuropeptide Substance P in which the peak at about 675 Da represents the original doubly charged unfragmented ion.

Semi-Continuous Mode

Neurotensin

Figure 17B:
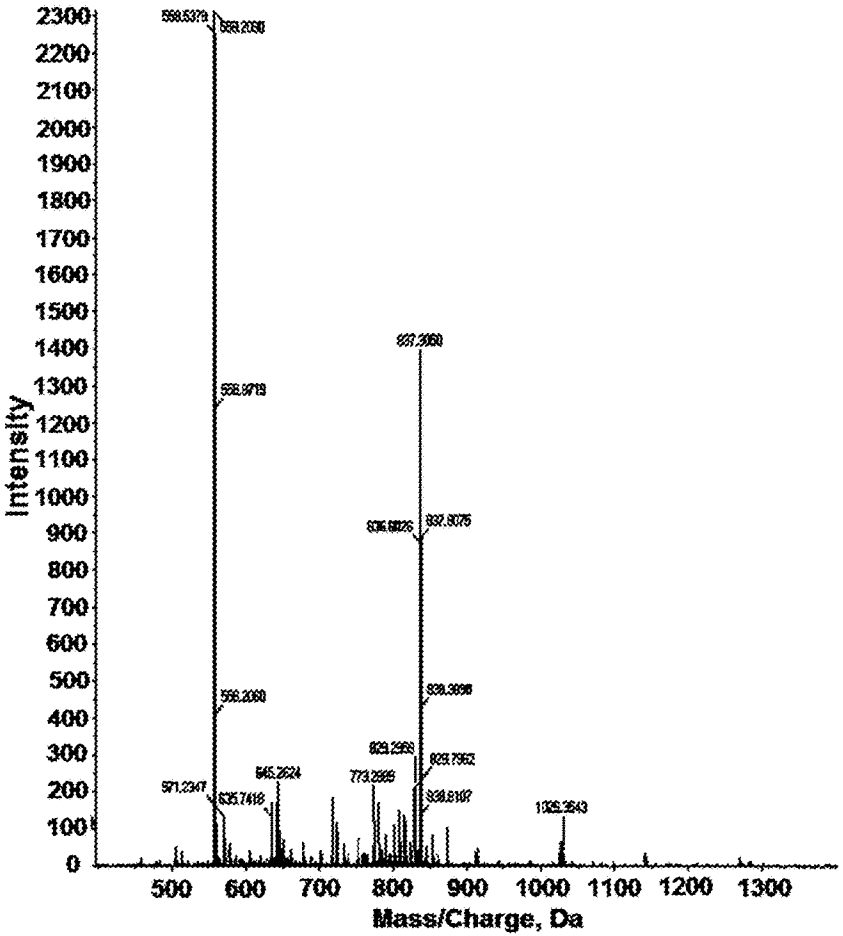
FIGS. 17A and B depicts mass spectra of triply protonated neurotensin obtained in the semi or quasi-continuous mode of operation of an apparatus in accordance with an embodiment of the invention.
Figure 17A:
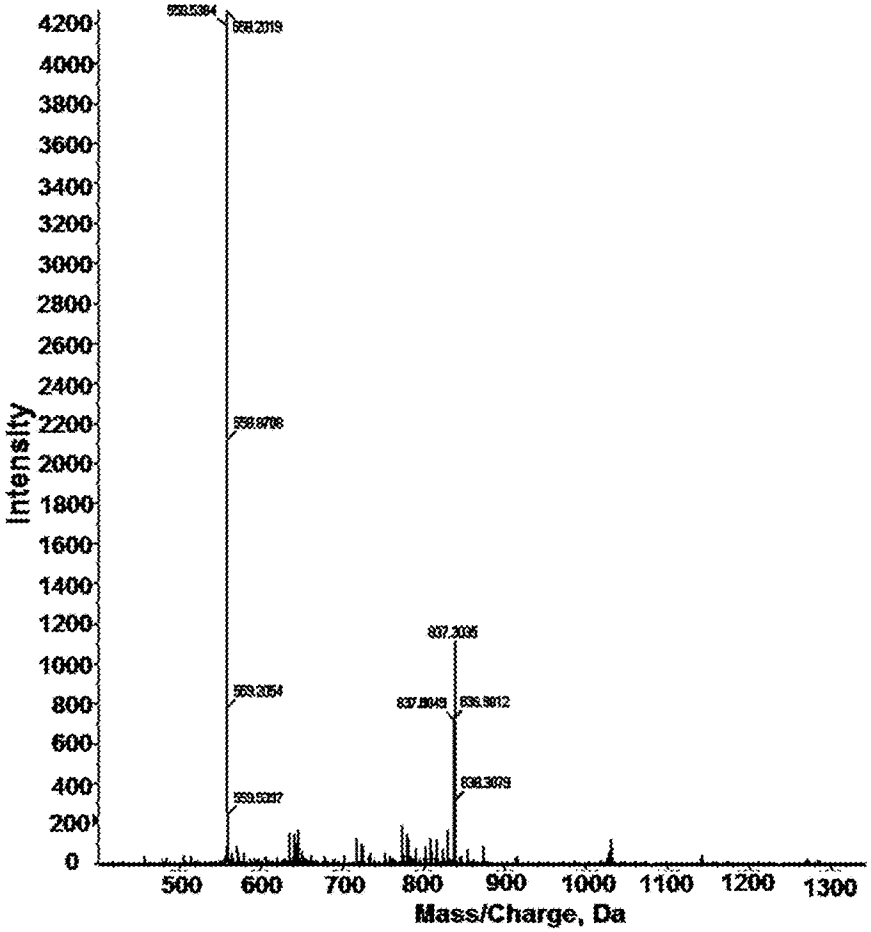

In a semi-continuous mode, the apparatus is configured in a fashion such that the entrance gate of the ion pathway is continuously open, whereas the exit gate of the ion pathway switches between an open and closed position. The entrance gate for the electron pathway can be opened continuously. When the exit gate of the ion pathway is in a closed position, ions are unable to exit the apparatus through the exit gate and an accumulation of ions takes place within the apparatus. Electrons which are continuously entering the apparatus orthogonally to the incoming ion stream interact with the ions as they accumulate, some of the ions undergoing ECD to fragment. Once a sufficient amount of time has passed, the exit gate of the ion pathway is then opened to allow a removal of the product ions and unreacted ions that have accumulated. These exiting ions can then be further processed and/or manipulated in subsequent stages and/or analyzed using an ion detector. FIGS. 17*a* and 17*b* depict mass spectra obtained from neurotensin and demonstrates that increasing the length of time in which the exit gate of the ion pathway is closed increases the chances that accumulated ions within the apparatus will undergo ECD. FIG. 17*a* depicts the mass spectra obtained from ions received from an apparatus in accordance with the present teachings in which the exit gate of the ion pathway switches between an open and closed position in which the gate is closed for 2 ms and then opened for 8 ms. In FIG. 17*b*, a mass spectra is depicted in which the exit gate is closed for 7 ms and is open for 3 ms. In the settings utilized in FIG. 17*b*, the ions are allowed to accumulate for a longer period of time than in the settings utilized in FIG. 17*a* and as a result, more fragmentation of the ions can be seen as is evidenced by the ratio of the unreacted precursor ions peaks (at about 558 Da) to the fragmented product ions.

When the product exit lens was closed for a few millisecond during simultaneous injection of the electron beam and the precursor ions, fragment signals were found to be enhanced significantly with an ECD efficiency >60% in some cases. This adapted semi or pseudo flow-through mode also produced more fragments than a conventional trapping mode (entrance and exit lenses closed).

BSA

BSA digested by trypsin and by Lys C were injected onto a reversed phase C18 UPLC-ESI, where the acetonitrile concentration of the mobile phase was scanned from 2% to 40% for 10 min. As a data dependent acquisition condition, the five most intense peaks were selected for each survey MS scan. Spectrum accumulation was 0.2 sec, so five ECD spectra were obtained per second. This ECD technique provided sequence coverages of 85% (Lys C) and 75% (trypsin). For more detail, electron capture efficiency and dissociation efficiency in pseudo flow-through mode was examined using LC-ECD MS with single charge state selection. No significant differences between the amount of residual charge reduced precursor ions on different charge states ($[M+2H]^{+}$, $[M+3H]^{2+}$ and $[M+4H]^{3+}$) were noted, although the electron capture efficiency for $[M+2H]^{2+}$ precursors was half that of $[M+3H]^{3+}$ and $[M+4H]^{4+}$ precursors (~40% for 2+; 80% for 3+ and 4+). More importantly, even though the ECD efficiency for the doubly protonated cases was relatively low, the obtained ECD spectra were still provided clear ECD product peaks in the mass spectra.

Batch Mode

In batch mode, the apparatus is utilized in a manner in which the entrance and exit gates are operated in a fashion to allow ions into the apparatus in a non-continuous mode. Entrance gate of the ion pathway is open and exit gate of the ion pathway is closed and ions are transmitted through the entrance gate into the apparatus. During this time period, entrance gate of the electron pathway is closed. Once sufficient ions are accumulated within the apparatus, the entrance gate of the ion pathway is closed and entrance gate to the electron pathway is opened allowing electrons to enter into the apparatus where they can interact with the accumulated ions and cause ECD to fragment the ions. Once a sufficient period of time has passed for reaction, the electron entrance gate can be closed or the electron beam turned off and the exit gate of the ion pathway is opened to allow extraction of the fragmented product ions or unreacted precursor ions which can then be further processed and/or manipulated and/or analyzed using an ion detector. The duration of time in which the ion exit gate is closed and in which the interaction between ion and electron can be pre-determined as a function of the charge state of the original precursor ions, or can set manually based on experience.

It should be appreciated that numerous changes can be made to the disclosed embodiments without departing from the scope of the present teachings. While the foregoing figures and examples refer to specific elements, this is intended to be by way of example and illustration only and not by way of limitation. It should be appreciated by the person skilled in the art that various changes can be made in form and details to the disclosed embodiments without departing from the scope of the teachings encompassed by the appended claims.

The invention claimed is:

1. A reaction apparatus for ions comprising:

a first pathway comprising a first axial end and a second axial end disposed at a distance from the first pathway axial end along a first central axis;

a second pathway comprising a first axial end and a second axial end disposed at a distance from the first axial end of the second pathway along a second central axis;

said first and second central axis being substantially orthogonal to one another and having an intersection point;

a first set of quadrupole electrodes arranged in a quadrupole orientation around said first central axis and disposed between said first axial end of said first pathway and said intersection point, said first set of electrodes for guiding ions along a first portion of said first central axis;

a second set of quadrupole electrodes arranged in a quadrupole orientation around said first central axis and disposed between said second axial end of said first pathway and said intersection point, said second set of electrodes for guiding ions along a second portion of said first central axis;

the first set of electrodes being separated from the second set of electrodes so as to form a gap transverse to said first central axis;

a voltage source for providing an RF voltage to said first and second sets of electrodes to generate an RF field;

a controller for controlling said RF voltages;

an ion source disposed at or proximate either the first or second axial end of said first pathway configured to introduce ions along said first central axis towards the other of said first or second axial end of the first pathway; and a charged species source disposed at or proximate either the first or second axial end of the second pathway configured to introduce a charged species along the second central axis, said charged species travelling through said gap towards said intersection point, wherein said controller is configured to deliver RF voltages to said electrodes such that each electrode in said first plurality of electrodes is paired with an electrode in said second plurality of electrodes to form an electrode pair wherein each electrode in each electrode pair has opposite RF polarity and is directly opposite across the intersection point of the other electrode in the electrode pair and wherein the RF fields generated between said intersection point and said first axial end of said second pathway by said first and second plurality of electrodes is in reverse phase to the RF fields generated between said intersection point and said second axial end of said second pathway;

a magnetic field generator that generates a magnetic field parallel to and along said second central axis;

wherein said ions are cations and said charged species are electrons;

and wherein, in operation, said cations and electrons react at said intersection point.

2. The apparatus of claim 1 wherein said charged species source is a filament or a $Y_2O_3$ cathode and optionally wherein the filament is a tungsten or thoriated tungsten filament.

3. The apparatus of claim 1 wherein said first pathway comprises a gate disposed or proximate to the axial end opposite of said first or second axial end at which said ions are introduced.

4. The apparatus of claim 1 wherein said first pathway comprises a gate disposed at or proximate to each of both said first and second axial ends wherein one of said gates is for controlling the introduction of said ions and the other of said gates is for controlling the removal of said ions or the reaction products of said ions.

5. The apparatus of claim 1 wherein said apparatus also comprises a gate electrode disposed at or proximate to each of both the first and second axial ends of said second pathway.

6. The apparatus of claim 1 wherein said second pathway comprises lenses disposed at or proximate to said first or second axial ends for focusing said charged species.

7. The apparatus of claim 1 wherein said second pathway comprises a laser source disposed at or proximate to the axial end opposite of said end for introduction of said charged species, said laser source for providing energy to said ions or said charged species.

8. The apparatus of claim 7 wherein said laser source provides ultraviolet or infrared light.

9. The apparatus of claim 1 wherein both of said axial ends of said second pathway comprise a charged species source and said charged species are electrons and wherein only one of said charged species sources is operational at a time.

10. The apparatus of claim 1 wherein said ions interact with said charged species and optionally wherein the interaction causes electron capture dissociation, electron transfer dissociation or proton transfer dissociation.

11. The apparatus of claim 1 wherein the RF fields generated are at a frequency of between about 400 kHz to 1.2 MHz.

12. The apparatus of claim 11 wherein the frequency is about 800 kHz.

13. A method for performing an electron capture dissociation reaction comprising:

providing a first pathway comprising a first axial end and a second axial end disposed at a distance from the first pathway axial end along a first central axis;

providing a second pathway comprising a first axial end and a second axial end disposed at a distance from the second pathway axial end along a second central axis;

positioning said first and second central axis such that the first and second central axis are substantially orthogonal to one another and having an intersection point;

providing a first set of quadrupole electrodes arranged in a quadrupole orientation around said first central axis and disposed between said first axial end of said first pathway and said intersection point, said first set of electrodes configured to guide ions along a first portion of said first central axis;

providing a second set of quadrupole electrodes arranged in a quadrupole orientation around said first central axis and disposed between said second axial end of said first pathway and said intersection point, said second set of electrodes configured to guide ions along a second portion of said first central axis;

the first set of electrodes being separated from the second set of electrodes so as to form a gap transverse to said first central axis;

providing a magnetic field parallel to said second central axis;

providing RF voltages to said first and second sets of electrodes;

providing a controller for controlling the RF voltages so as to control the RF fields generated by said first and second sets of electrodes and wherein said controller is configured to deliver RF voltages to said electrodes such that each electrode in said first plurality of electrodes is paired with an electrode in said second plurality of electrodes to form an electrode pair wherein each electrode in each electrode pair has opposite RF polarity and is directly opposite across the intersection point of the other electrode in the electrode pair and wherein the RF fields generated between said intersection point and said first axial end of said second pathway by said first and second plurality of electrodes is in reverse phase to the RF fields generated between said intersection point and said second axial end of said second pathway;

introducing a plurality of positively charged ions into either the first or second axial end of said first pathway along said first central axis; and introducing electrons into the first or second axial end of the second pathway along the second central axis, said electrons travelling through said gap towards said intersection point and reacting said positively charged ions with said electrons at said intersection point.

14. The method of claim 13 further comprising:

providing a gate in said first pathway at or proximate to the axial end that is opposite of said axial end wherein said positively charged ions are introduced, said gate being switchable between an open and closed position wherein when in an open position, said ions or product of said ion reaction is allowed to pass and when in a closed position, said ions or product of said ion reactions is not allowed to pass.

15. The method of claim 14 wherein said gate is open continuously.

16. The method of claim 14 further comprising:

controlling the lengths of time when said gate is open and when said gate is closed.

17. The method of claim 13 wherein said electrons are introduced via a filament or a $Y_2O_3$ cathode and optionally that the filament is a tungsten or thoriated tungsten filament.

18. The method of claim 13 further comprising providing lenses disposed at or proximate to either said first or second axial ends of said second pathway for focusing said positively charged species.

* * * * *